US008748717B2

(12) United States Patent
Mason

(10) Patent No.: US 8,748,717 B2
(45) Date of Patent: Jun. 10, 2014

(54) GUITAR ACCESSORIES

(76) Inventor: Michael Cory Mason, Vancouver, WA (US)

( * ) Notice: Subject to any disclaimer, the term of this patent is extended or adjusted under 35 U.S.C. 154(b) by 0 days.

(21) Appl. No.: 13/441,773

(22) Filed: Apr. 6, 2012

(65) Prior Publication Data

US 2013/0055876 A1 Mar. 7, 2013

Related U.S. Application Data

(60) Provisional application No. 61/472,564, filed on Apr. 6, 2011.

(51) Int. Cl.
*G10D 3/04* (2006.01)
*G10D 3/14* (2006.01)

(52) U.S. Cl.
CPC . *G10D 3/04* (2013.01); *G10D 3/146* (2013.01)
USPC ..... 84/298; 84/299; 84/313

(58) Field of Classification Search
USPC ..... 84/298, 299, 313
See application file for complete search history.

(56) References Cited

U.S. PATENT DOCUMENTS

| | | | | | |
|---|---|---|---|---|---|
| 490,528 | A | | 1/1893 | Wooster | |
| 2,565,253 | A | | 8/1951 | Melita | |
| 2,614,449 | A | * | 10/1952 | Machalek | 84/312 R |
| 2,740,313 | A | | 4/1956 | McCarty | |
| 3,124,991 | A | * | 3/1964 | Costen | 84/267 |
| 3,248,991 | A | | 5/1966 | Cole | |
| 3,500,711 | A | * | 3/1970 | Fender | 84/313 |
| 3,563,126 | A | | 2/1971 | Connington | |
| 3,583,272 | A | * | 6/1971 | Eurich | 84/267 |
| 4,020,730 | A | * | 5/1977 | Hill | 84/173 |
| 4,135,426 | A | | 1/1979 | Rickard | |
| 4,248,126 | A | | 2/1981 | Lieber | |
| 4,334,454 | A | | 6/1982 | Wall | |
| 4,341,144 | A | * | 7/1982 | Milne | 84/307 |
| 4,385,543 | A | | 5/1983 | Shaw et al. | |
| 4,430,919 | A | | 2/1984 | Matsui | |
| 4,457,201 | A | * | 7/1984 | Storey | 84/313 |
| 4,487,100 | A | * | 12/1984 | Storey | 84/299 |
| 4,643,070 | A | | 2/1987 | Petrillo | |
| 4,655,116 | A | | 4/1987 | Matsui | |
| 4,656,915 | A | * | 4/1987 | Osuga | 84/313 |
| 4,688,461 | A | | 8/1987 | Stroh | |
| 4,742,750 | A | | 5/1988 | Storey | |
| 4,768,414 | A | | 9/1988 | Wheelwright | |
| 4,843,941 | A | | 7/1989 | Nichols et al. | |
| 4,882,967 | A | | 11/1989 | Rose | |
| 4,939,971 | A | | 7/1990 | Satoh | |
| 4,951,543 | A | | 8/1990 | Cipriani | |
| 5,052,260 | A | | 10/1991 | Cipriani | |
| 5,171,927 | A | | 12/1992 | Kubicki et al. | |
| 5,260,505 | A | | 11/1993 | Kendall | |
| 5,271,307 | A | | 12/1993 | Pollock | |
| 5,672,835 | A | | 9/1997 | Doughty | |
| 6,372,971 | B1 | | 4/2002 | Rogers | |
| 6,465,722 | B2 | * | 10/2002 | Powers | 84/298 |

(Continued)

*Primary Examiner* — Robert W Horn
(74) *Attorney, Agent, or Firm* — Kolisch Hartwell, PC

(57) ABSTRACT

A string-doubling apparatus and a face-mounted whammy bar system for stringed instruments are disclosed. A string-doubling apparatus may include a bridge portion and a nut assembly, both with multiple bearing surfaces to facilitate a double stringing of the instrument. A face-mounted whammy bar system may include a lever arm and a rotatable rod for manually and reversibly altering the string tension of an instrument.

20 Claims, 29 Drawing Sheets

(56) References Cited

U.S. PATENT DOCUMENTS

| | | | | |
|---|---|---|---|---|
| 6,521,819 | B1 | 2/2003 | Di Iorio | |
| 6,765,137 | B2 | 7/2004 | Smart | |
| 6,812,389 | B2 | 11/2004 | Trooien | |
| 6,822,156 | B1 | 11/2004 | Wai et al. | |
| 6,875,911 | B2 * | 4/2005 | Schryer | 84/313 |
| 6,881,882 | B2 | 4/2005 | Ito et al. | |
| 6,884,932 | B2 | 4/2005 | Wrona et al. | |
| D521,047 | S | 5/2006 | Meadors | |
| 7,045,693 | B2 | 5/2006 | Rose et al. | |
| 7,189,908 | B2 | 3/2007 | Lavineway | |
| 7,327,109 | B1 | 2/2008 | Hagen | |
| 7,351,895 | B1 | 4/2008 | LeBlanc | |
| 7,459,619 | B2 * | 12/2008 | Gawenda | 84/313 |
| 7,479,592 | B1 * | 1/2009 | Slavik | 84/313 |
| 7,534,950 | B2 * | 5/2009 | Lyles | 84/453 |
| 7,579,536 | B2 * | 8/2009 | Bonebrake | 84/312 R |
| 7,807,906 | B2 * | 10/2010 | Dain | 84/173 |
| 7,868,235 | B2 * | 1/2011 | Medas | 84/298 |
| 7,960,630 | B2 * | 6/2011 | Steinberger | 84/313 |
| 8,217,244 | B2 * | 7/2012 | Dain | 84/214 |
| 8,294,011 | B2 * | 10/2012 | Toone | 84/313 |
| 8,389,836 | B2 * | 3/2013 | Uberbacher | 84/312 R |
| 2013/0055876 | A1 * | 3/2013 | Mason | 84/298 |

* cited by examiner

GUITAR ACCESSORIES

CROSS-REFERENCE TO RELATED APPLICATIONS

This application claims priority to U.S. Provisional Patent Application Ser. No. 61/472,564, which was filed on Apr. 6, 2011 and entitled GUITAR ACCESSORIES. The complete disclosure of the above application is hereby incorporated by reference for all purposes.

BACKGROUND OF THE DISCLOSURE

Various methods and systems for enhancing the sound of stringed instruments have been developed throughout history. Additionally, various configurations of stringed instruments have been devised, for instance varying the number of strings on an instrument, varying the tuning method or scheme, or varying the size of the instrument itself. More recently, tremolo bars, also known as whammy bars, have been developed to allow an electric guitar player to create vibrato and/or otherwise alter the pitch of the strings by manually manipulating a lever arm on the guitar body. In the prior art, whammy bar installation involved significant modification to the body of a guitar, including routing and drilling of an electric guitar's otherwise solid body.

Examples of such systems and other related systems are disclosed in U.S. Pat. Nos. 490,528; 2,565,253; 3,248,991; 3,563,126; 4,135,426; 4,248,126; 4,334,454; 4,385,543; 4,430,919; 4,457,201; 4,487,100; 4,655,116; 4,688,461; 4,742,750; 4,768,414; 4,843,941; 4,882,967; 4,939,971; 4,951,543; 5,052,260; 5,171,927; 5,260,505; 5,271,307; 5,672,835; 6,372,971; 6,521,819; 6,765,137; 6,812,389; 6,822,156; 6,881,882; 6,884,932; 7,045,693; 7,189,908; 7,327,109; 7,351,895; and D521,047. The complete disclosures of the above patents and other publications referenced hereby incorporated by reference for all purposes.

SUMMARY OF THE DISCLOSURE

A string doubling system is described which allows one or more strings of an existing guitar or other stringed instrument to be strung in either a single-string configuration using conventional-length strings or a double-string configuration using double-length strings. The guitar may then be tuned conventionally using pre-existing tuning pegs. The use of bearings in many locations where prior art instruments typically include static slots or grooves may reduce overall friction experienced by an instrument's strings. For example, there may be a reduced need for strings to slide across hard surfaces such as plastic, bone, metal, or graphite during the tuning process. Any string that has been doubled will have a richer tone, since two strings will be played simultaneously where previously there had only been one. Using a string doubling system, a user may choose to double certain strings while leaving others in the conventional single-string configuration. For example, higher-pitch guitar strings may be left in single-string configuration to allow conventional guitar riffs or solos. Lower-pitch guitar strings may be doubled to provide more body or richness of tone, for example when playing power chords or rhythm guitar.

A face-mounted whammy bar system is also described which may be installed on the front face of the body of an electric guitar without extensive routing or other modification to the guitar body. A spring-loaded tremolo rod is provided which alters tension on the strings of a guitar when a whammy bar is used as a lever to partially rotate the rod in either direction.

DETAILED DESCRIPTION OF THE DISCLOSURE

Examples of a string doubling apparatus are shown in FIGS. 1-17 and 25-27. Examples of tremolo (whammy) bar systems are shown in FIGS. 18-24. Unless otherwise specified, a string doubling apparatus or whammy bar system may contain at least one of the structure, components, functionality, and/or variations described, illustrated, and/or incorporated herein. It is noted that terminology consistent with guitars is frequently used in this description. However, that terminology is merely used for ease of understanding, and it should be understood that the description may be applied to other suitable stringed instruments as well. Terms such as "horizontal" should be interpreted to mean substantially in a plane approximately parallel to the face of the body of the instrument, whereas terms such as "vertical" should be interpreted to mean substantially in a plane approximately orthogonal to the face of the body of the instrument.

Figure 1:
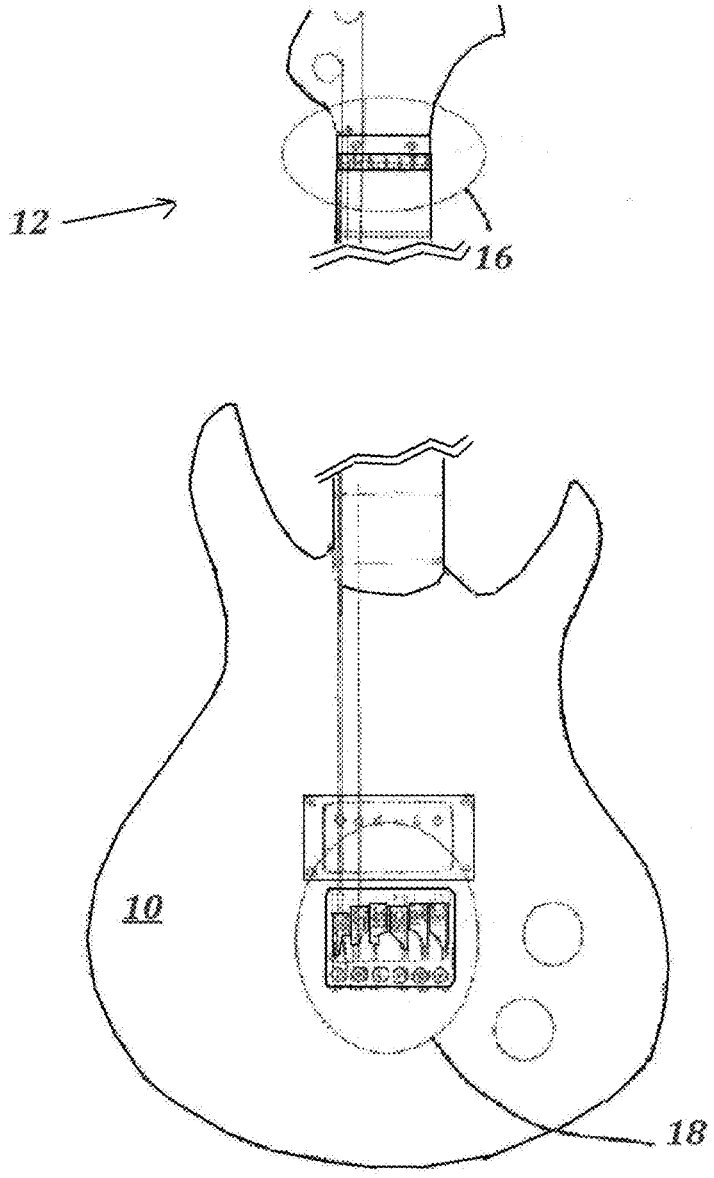
FIG. 1 shows a guitar having an illustrative string doubling system.

FIG. 1 depicts an example of a stringed instrument, here guitar 10, showing general placement of a string doubling system, generally indicated at 12, including nut apparatus 16 and bridge 18. Guitar 10 may generally include a neck, a body, tuning pegs, and fretwork, and may be originally configured with a plurality of strings, for example four strings for a bass guitar or six strings for a conventional guitar. The body of guitar 10 may be hollow, as is typical in acoustic guitars, or substantially solid, as typical in electric guitars. Examples of bridge 18 are described in more detail below, and may replace a standard bridge or be installed during manufacture in a standard bridge location for stringed instruments, as shown in FIG. 1. Examples of nut apparatus 16 are also described in further detail below, and may replace a standard nut or be installed during manufacture in a standard nut location for stringed instruments, as shown in FIG. 1.

Figure 3:
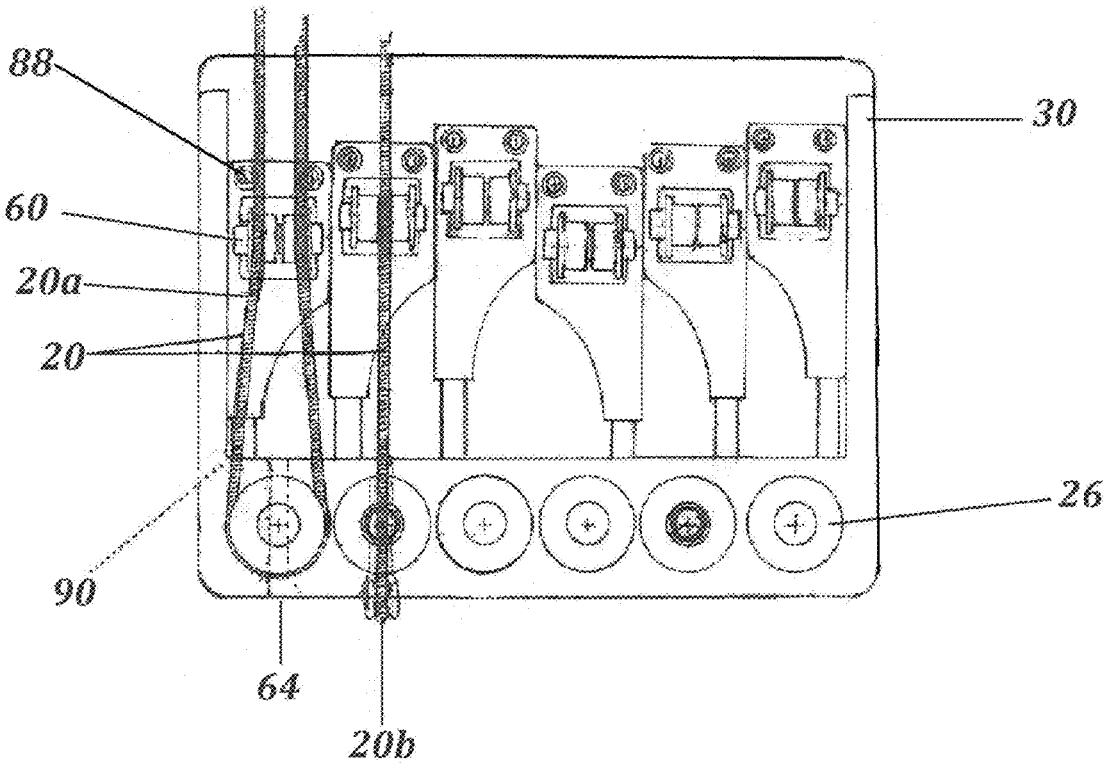
FIG. 3 shows a plan view of a bridge portion of an illustrative string doubling system with strings in two different configurations.

Using a string doubling system 12, any one or more of strings 20 may be configured in a single-string arrangement (20*b* in FIG. 3) or a double-string arrangement (20*a* in FIG. 3). In a single-string arrangement, string 20 may be a standard length guitar string and may be strung through a hole in bridge 18, up across the body and neck of guitar 10 to nut apparatus 16 and a tuning peg of guitar 10. A ball end 74 of string 20 may be secured in bridge 18 while a non-ball end is secured at a tuning peg. In a double-string arrangement, string 20 may be at least twice the length of a standard guitar string. In a double-string arrangement, string 20 may be strung starting at a nut apparatus 16 end of guitar 10 such that ball end 74 is secured at a nut apparatus 16 end rather than at bridge 18, string 20 runs down over nut apparatus 16 and the neck and body of guitar 10, around a bearing portion of bridge 18, back up across the body, neck, and nut, and secured using a tuning peg of guitar 10. All aforementioned components are described in greater detail in the following paragraphs.

Figure 2:
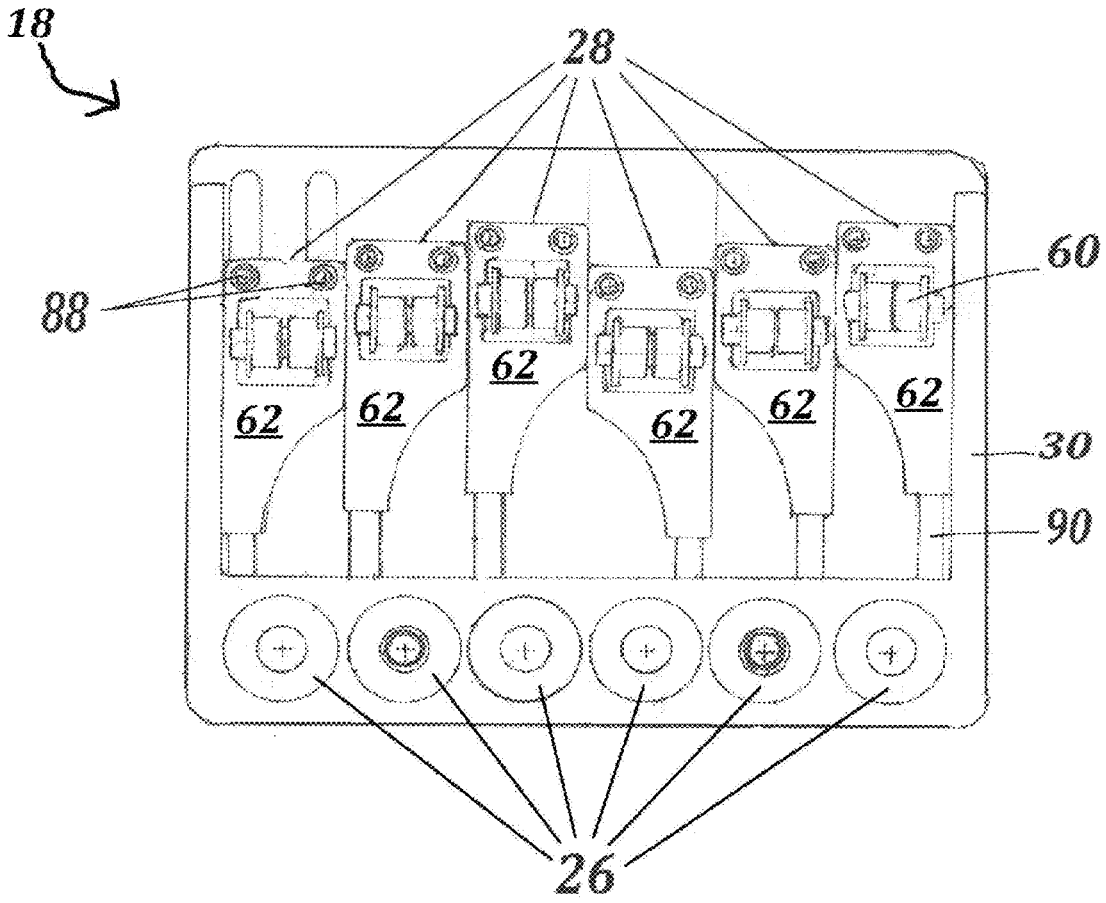
FIG. 2 shows a plan view of a bridge portion of an illustrative string doubling system.

FIGS. 2 and 3 show a more detailed view of an illustrative bridge 18 of an illustrative string doubling system 12 for a six-string guitar. Bridge 18 may be any suitable structure configured to act as a conventional bridge while also allowing individual strings to be strung singly or doubly. For example, bridge 18 may include horizontal bearings 26, bridge saddle bearings 28, bridge base plate 30, and/or bridge bearing lock 32 (shown in FIG. 4).

Horizontal bearings 26 may be any suitable structure configured to allow a string 20 to be doubled back on itself by looping around a continuous bearing surface. For example, horizontal bearings 26 may be flanged circular friction or roller bearings configured in a horizontal plane. Horizontal bearings 26 may allow movement of string 20, such as may be desirable during tuning of string 20. Horizontal bearings 26 may be materially and structurally configured to bear the significant strain created by string 20 when under tension and when being played by a musician.

Figure 4:
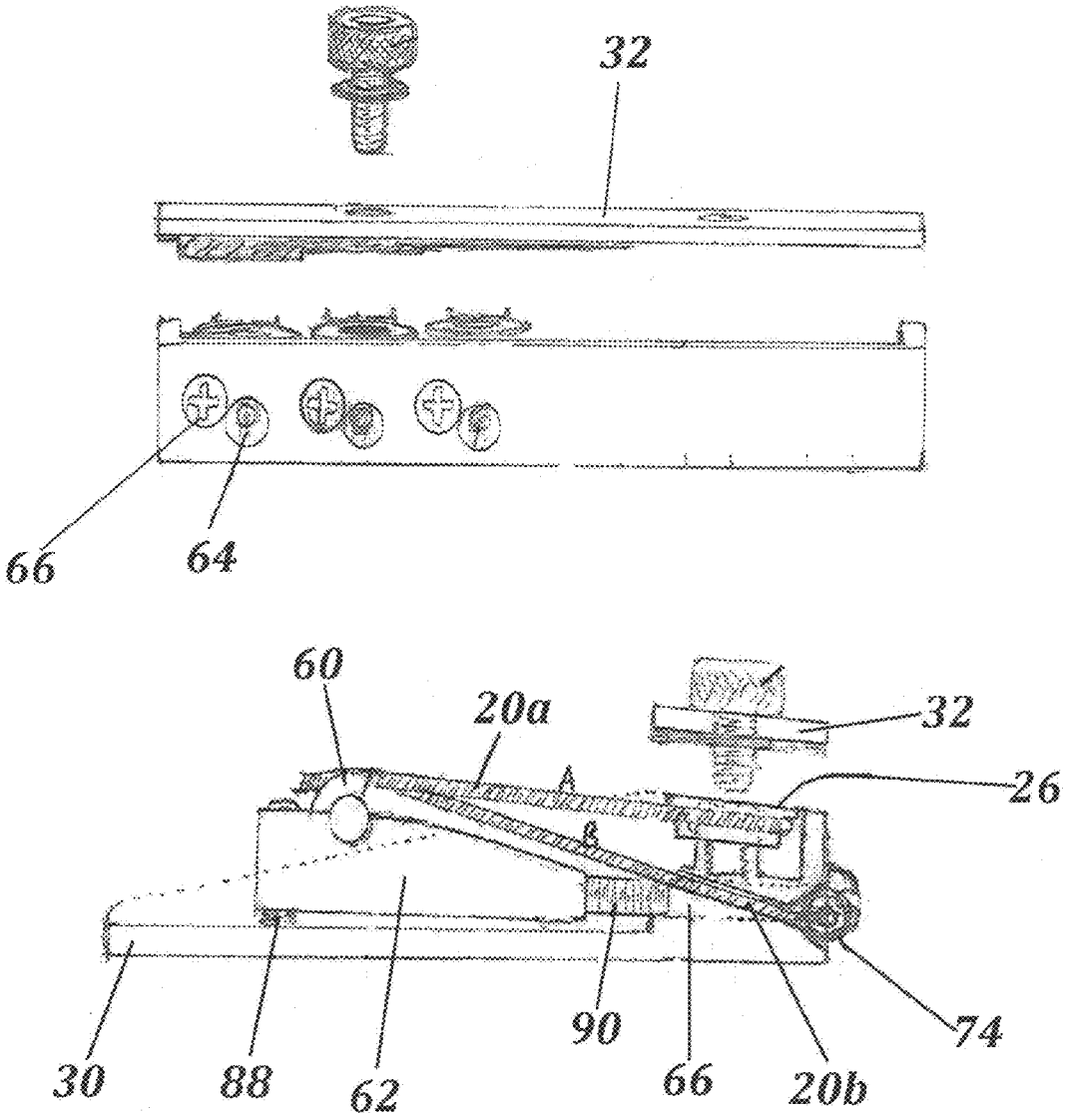
FIG. 4 shows a partially exploded rear view (top) and a side cutaway view (bottom) of a bridge portion of an illustrative string doubling system.

Bridge saddle bearings 28 may be any suitable structures configured to horizontally and vertically align each string 20 in proper playing alignment regardless of whether string 20 is strung in a single or a double configuration. For example, bridge saddle bearings 28 may each include bearing 60 and saddle bearing base 62. Bearing 60 may be flanged and/or grooved to allow string 20 to remain properly aligned in single or doubled configuration (see FIG. 16 for corresponding structure on a nut apparatus 16 showing string 20). As shown in FIG. 3, flanges of bearing 60 provide lateral alignment in string configuration 20*a*, while a groove or gap in bearing 60 provides lateral alignment in string configuration 20*b*. Bearing 60 may be a flanged and grooved roller bearing or may be a two-piece flanged roller bearing with a gap between two independent pieces. Alternatively, bearing 60 may be a friction bearing configured to align string 20 as previously described. A groove or gap in bearing 60 may be sized to ensure a string in configuration 20*b* does not slip completely into the groove or gap but instead may remain aligned while riding on one or more upper surfaces or edges of the groove or gap. Consequently, different ones of bearing 60 may have differently-sized grooves or gaps to accommodate differently-sized corresponding strings 20. Saddle bearing base 62 may be any suitable structure configured to hold bearing 60 in position and may be configured to provide other functionality. For example, saddle bearing base 62 may include one or more height adjustment screws 88 and/or intonation adjustment screws 90. Height adjustment screws 88 may be any suitable structure configured to adjustably alter a vertical height of a corresponding one of bridge saddle bearings 28. For example, height adjustment screws 88 may be Allen screws set in threaded holes in saddle bearing base 62 as shown in FIGS. 2-4. Intonation adjustment screws 90 may be any suitable structure configured to adjustably alter a horizontal alignment of a corresponding one of bridge saddle bearings 28. For example, intonation adjustment screws 90 may be Phillips or Allen screws running through an end of bridge base plate 30 and into an end of saddle bearing base 62.

Figure 29:
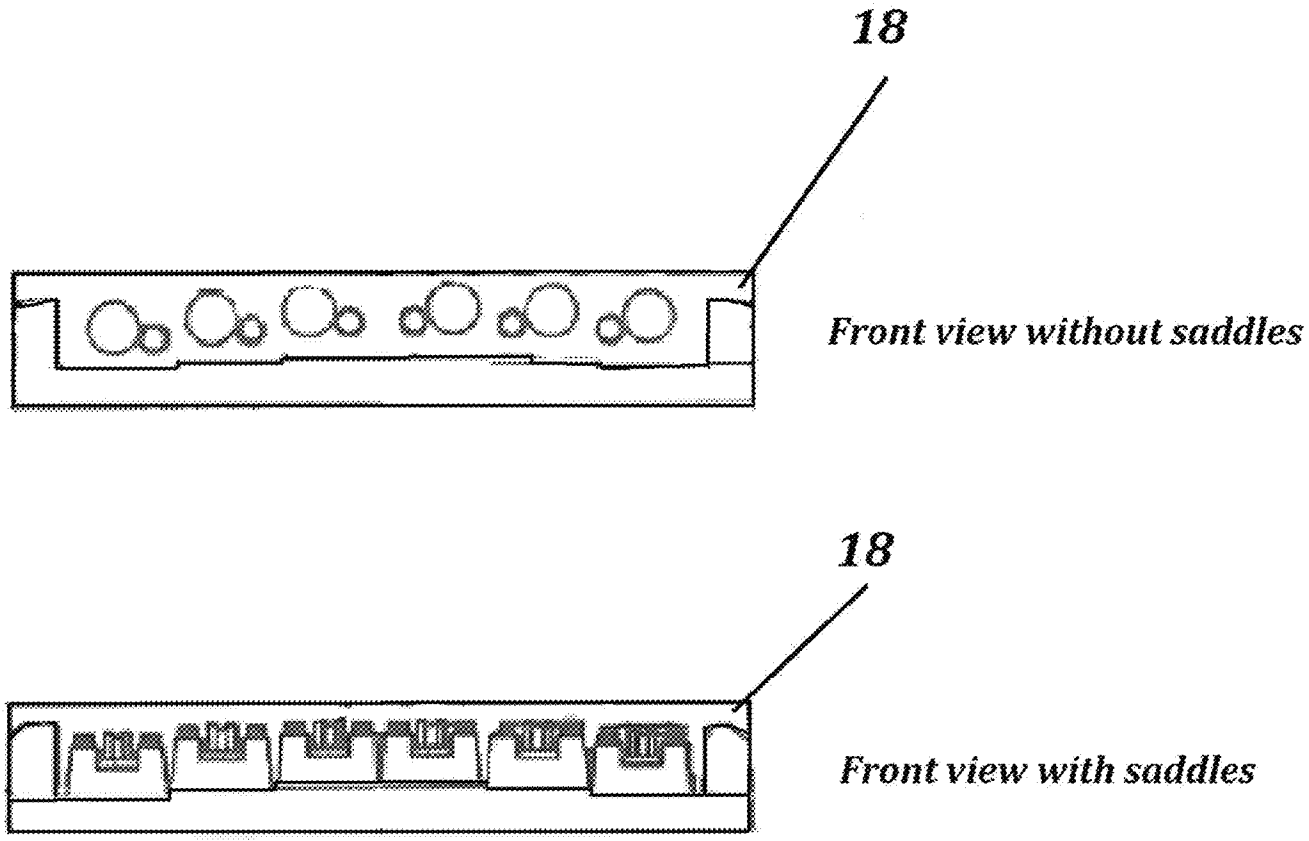
FIG. 29 shows another example of a bridge portion having stepped saddle bearing mounts.

Bridge base plate 30 may be any suitable structure configured to securely house components of bridge 18 and facilitate single and/or double stringing. For example, bridge base plate 30 may be a single structure which includes single-string holes 64 and intonation screw holes 66, and may contain or have attached horizontal bearings 26, bridge saddle bearings 28, and/or bridge bearing lock 32. In another example, bridge base plate 30 may consist of two pieces, a first portion 70 including bridge saddle bearings 28 and a second portion 72 including horizontal bearings 26. Whether one-piece or two, a bottom surface of bridge base plate 30 may be planar or may be curved to accommodate a corresponding mounting surface of guitar 10. Additionally, as shown in FIG. 29, bridge base plate 30 may include stepped portions configured to vertically align bridge saddle bearings 28 in a desired arrangement such as one corresponding to a curved instrument fingerboard surface.

Figure 5:
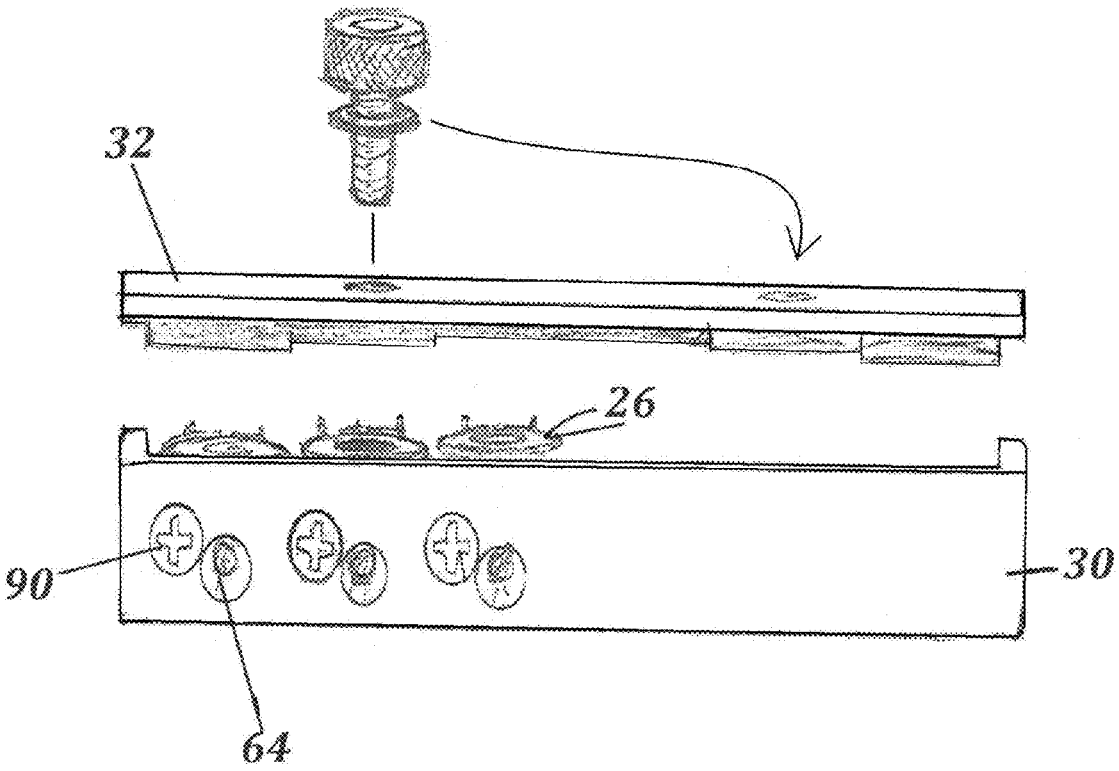
FIG. 5 shows a partially exploded rear view of a bridge portion of an illustrative string doubling system.

FIGS. 4 and 5 show an end view of an illustrative bridge 18. Bridge 18 may include bridge bearing lock 32, as shown in FIG. 4. Bridge bearing lock 32 may be any structure configured to secure horizontal bearings 26 from any rotational motion and may be configured to ensure string 20 does not slide off any of bearings 26 in a vertical direction. For example, bridge bearing lock 32 may be a rigid rectangular plate with pads made of a resilient material such as rubber mounted on a lower surface. Bridge bearing lock 32 may be configured to attach to bridge base plate 30 using bolts and threaded attachment holes as shown in FIGS. 4 and 5.

Figure 6:
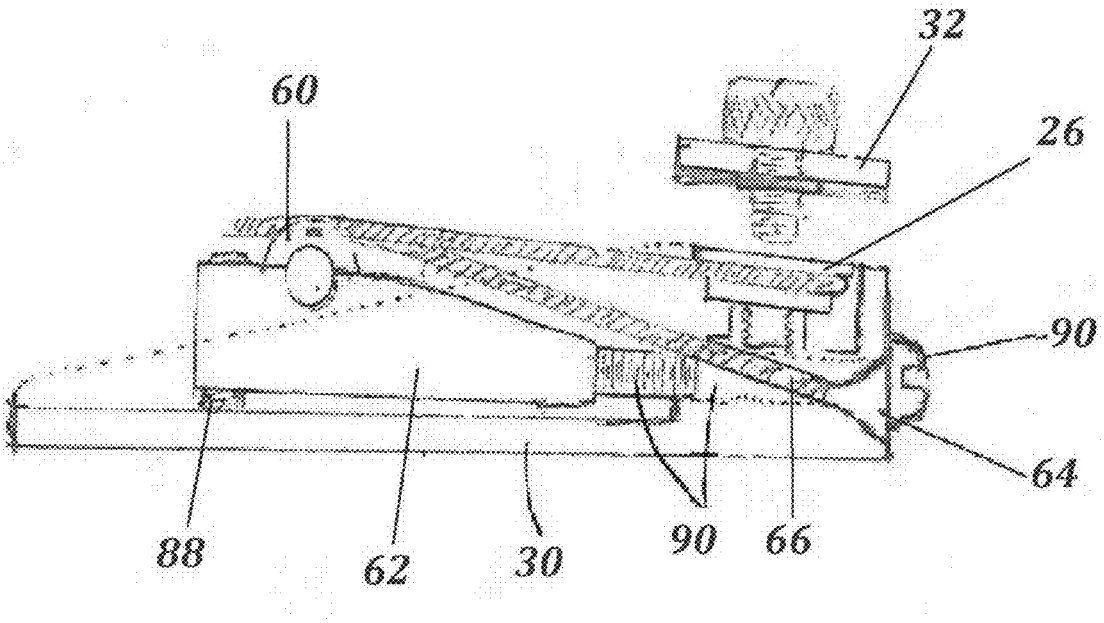
FIG. 6 shows a side cutaway view of a bridge portion of an illustrative string doubling system.
Figure 7A:
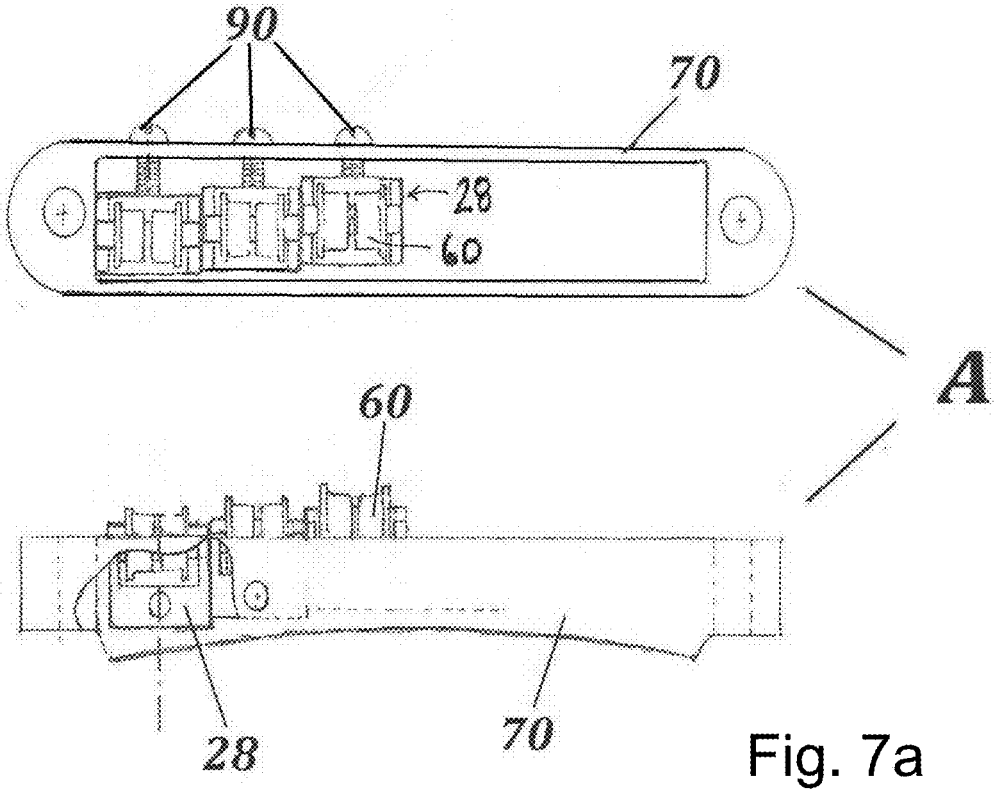
FIG. 7*a* shows a plan and side view of a bridge portion of an alternative illustrative string doubling system for use on instruments with curved surfaces.
Figure 7B:
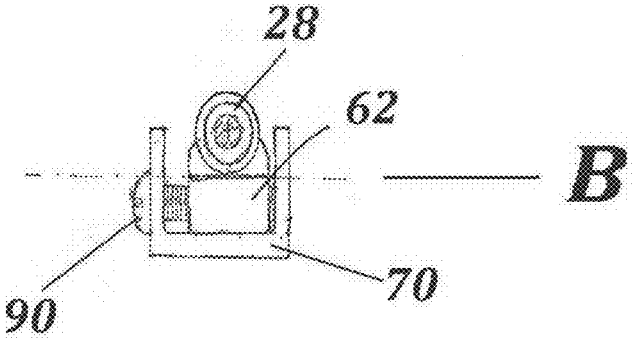
FIG. 7*b* shows a side view of an illustrative saddle bearing assembly from the bridge portion of FIG. 7*a*.

FIG. 6 shows a side view of an illustrative bridge 18. In this example, various holes in bridge base plate 30 may be seen. For example, intonation screw holes 66 may be configured as through-holes or as threaded holes, sized to accommodate corresponding intonation adjustment screws 90. Additionally, single-string holes 64 are represented, showing an enlarged opening where a ball end 74 of a string 20 may be secured.

Figure 8:
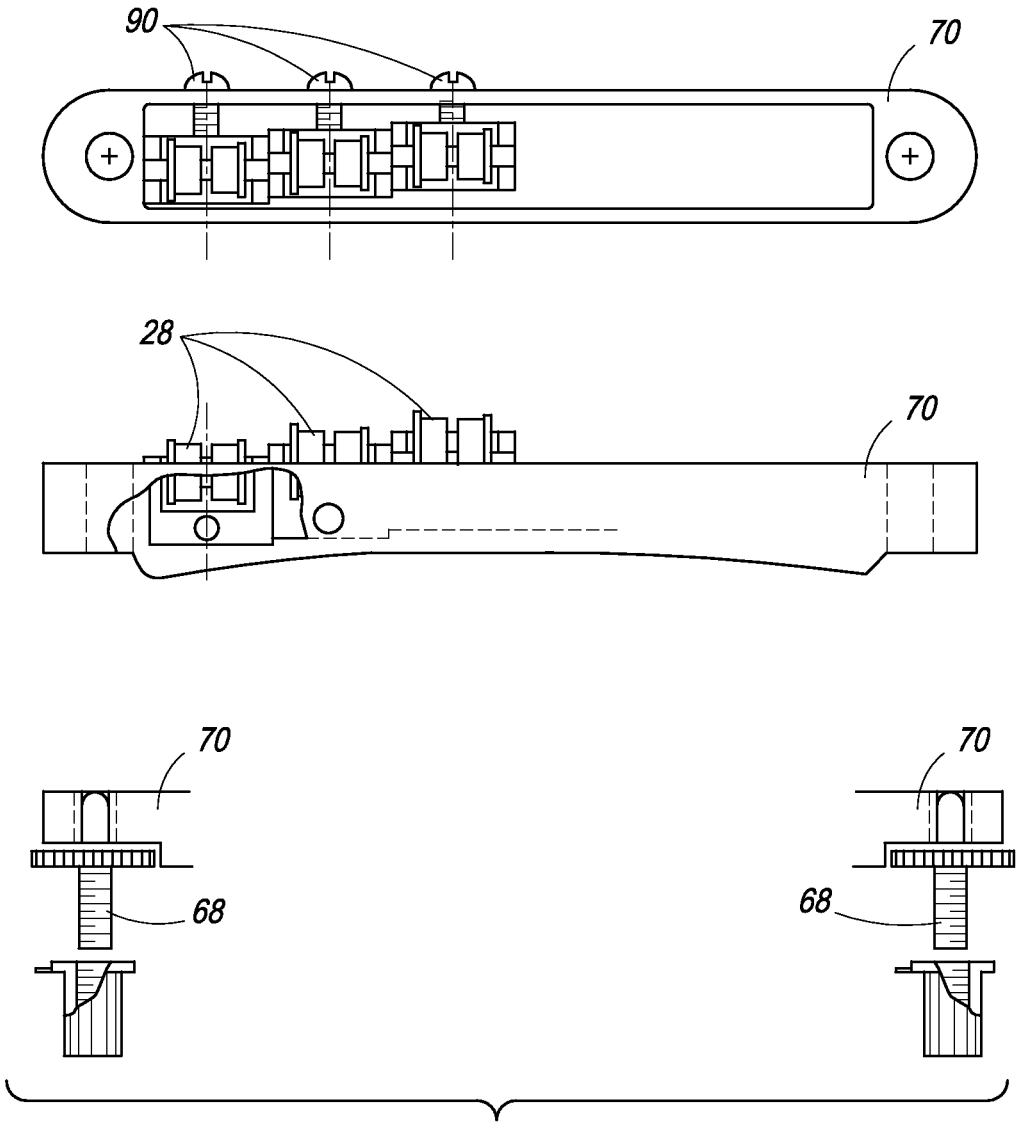
FIG. 8 shows the illustrative bridge portion of FIG. 7*a* with illustrative height adjustment screws.
Figure 9:
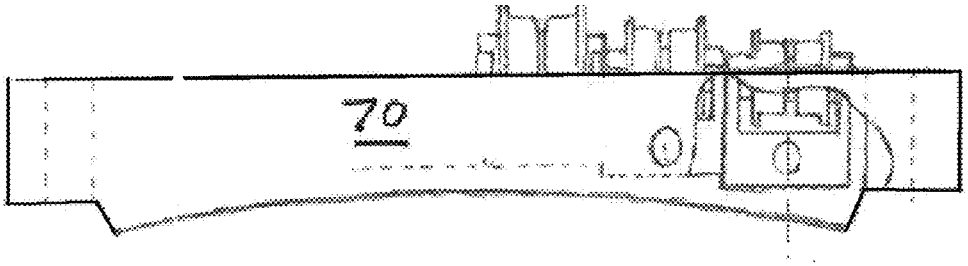
FIG. 9 shows a location of an illustrative height adjustment screw in the illustrative bridge portion of FIG. 7*a*.
Figure 9:
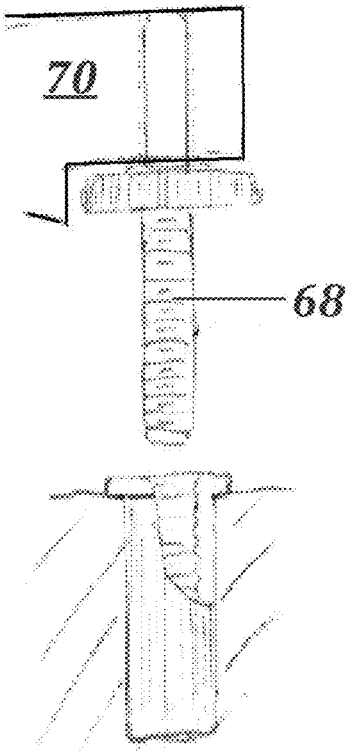

FIG. 7*a*-9 show an example of a first portion 70 of a two-piece bridge 18, showing a curved bottom surface and alternative embodiments of bridge saddle bearings 28. In this embodiment, rather than individual height adjustment screws 88 as previously described, first portion 70 may have two global height adjustment screws 68 as shown in FIGS. 8 and 9. First portion 70 may be mounted in alignment with second portion 72, with second portion 72 mounted toward a base end of the instrument. It may be helpful for those skilled in the art to analogize first portion 70 as corresponding to a tune-o-matic bridge and second portion 72 as corresponding to a stopbar.

Figure 10:
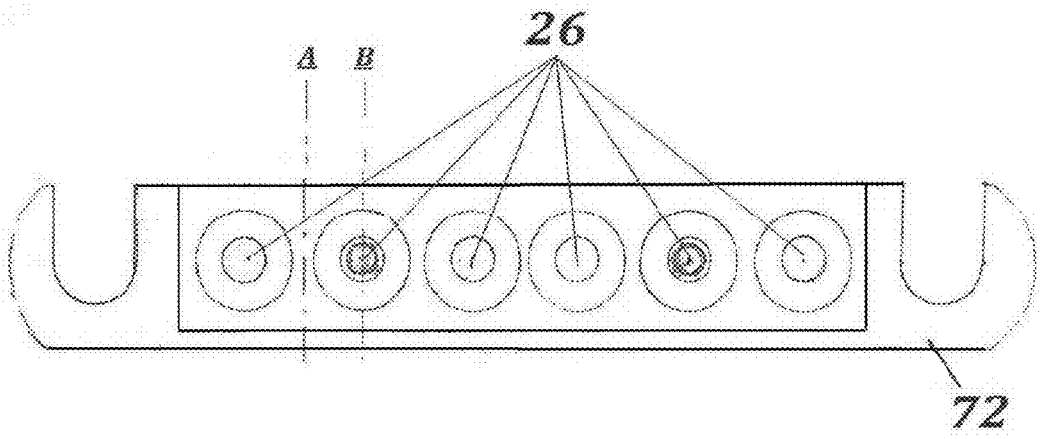
FIG. 10 shows a plan view and detail of a tail portion of an illustrative string doubling system.
Figure 10:
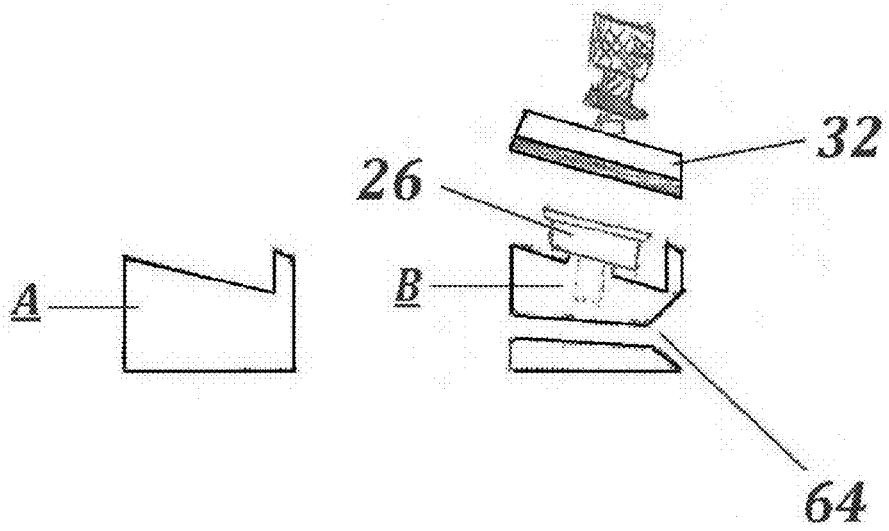
Figure 11A:
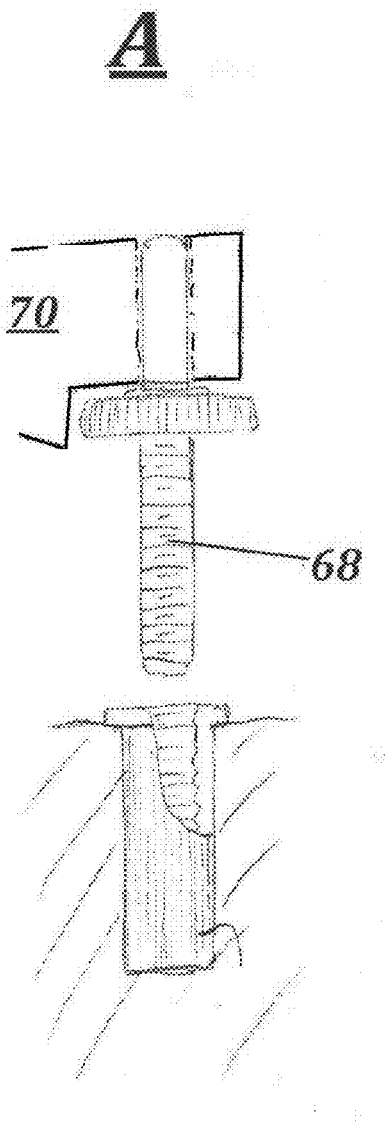
FIG. 11*a* shows an example of an attachment bolt for the illustrative bridge portion of FIG. 7*a*.
Figure 11B:
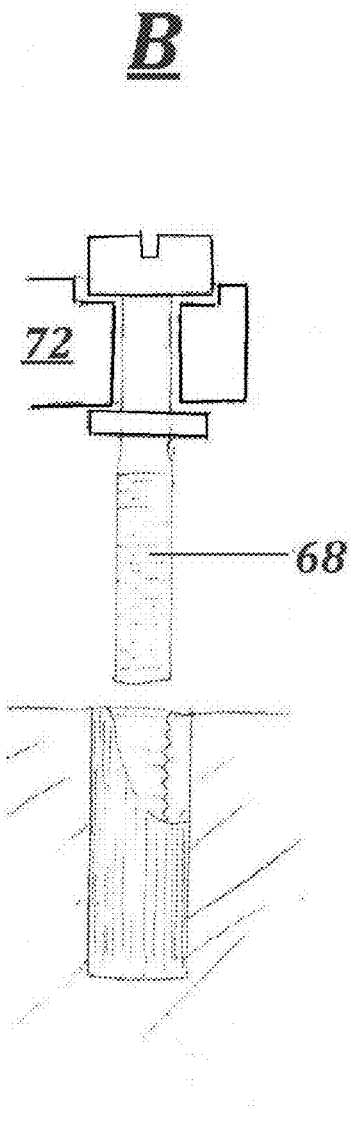
FIG. 11*b* shows an example of an attachment bolt for the tail portion of FIG. 10.

FIG. 10 shows an example of a second portion 72 of a two-piece bridge 18, showing horizontal bearing 26 configuration and illustrative mounting slots for second portion 72. FIGS. 11*a* and 11*b* show illustrative mounting means for first portion 70 and second portion 72.

Figure 12:
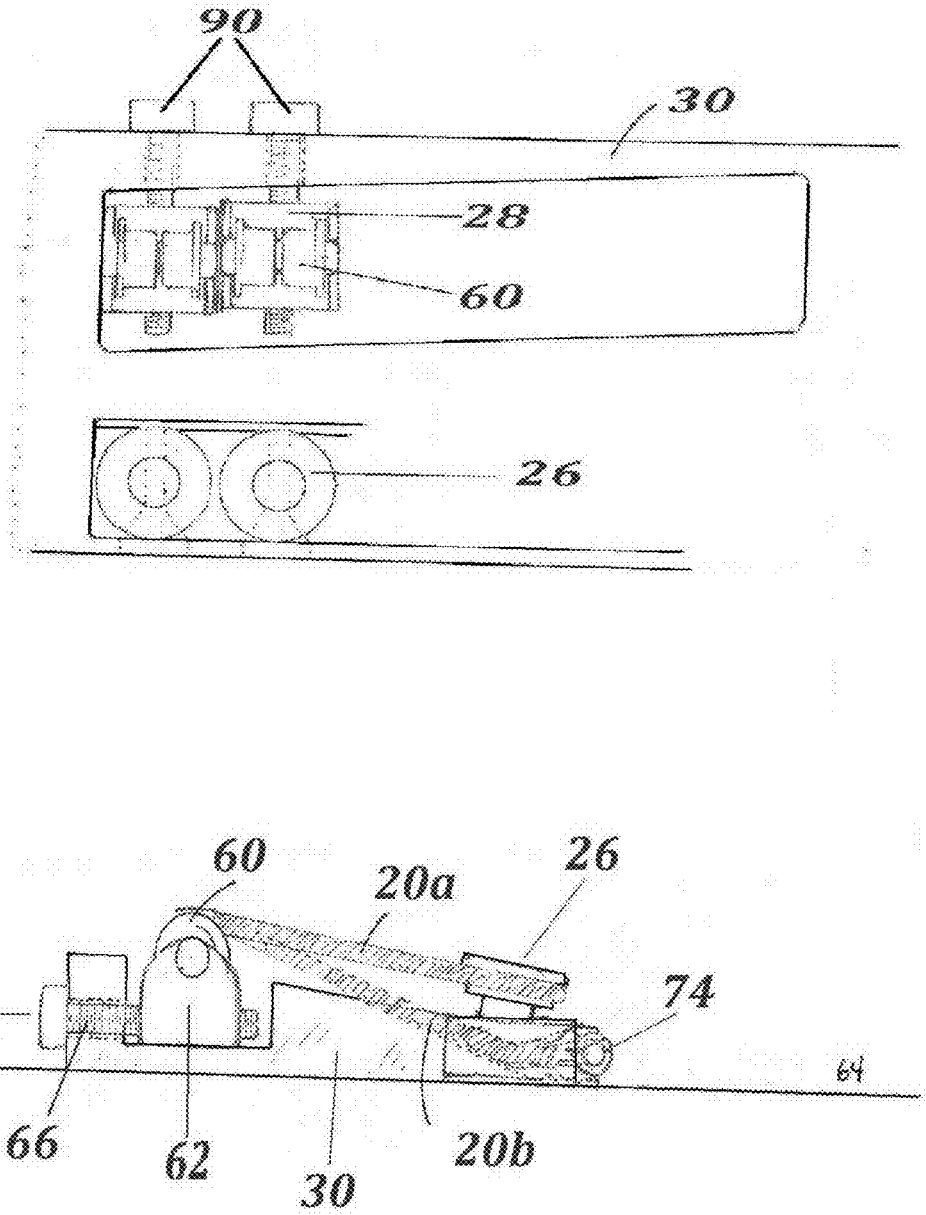
FIG. 12 shows a plan view and a side view of another example of a bridge portion of an illustrative string doubling system.

FIG. 12 shows another example of a bridge 12 such as may be used on an acoustic guitar. Bridge 12 in this example may be made of a single block of wood or other suitable rigid material, with a portion routed out to allow mounting of bridge saddle bearings 28. Other components of bridge 12 shown in FIG. 12 have been previously described.

Figure 13:
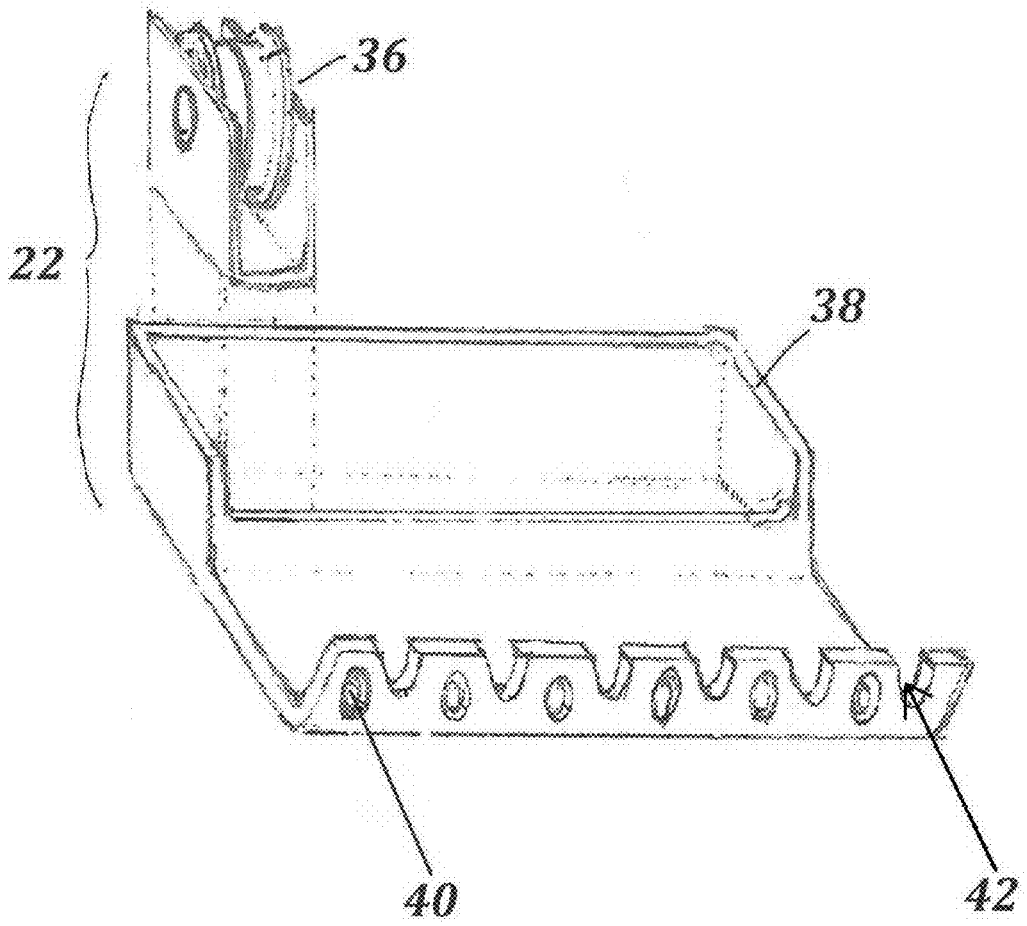
FIG. 13 shows a perspective view of an illustrative nut portion of an illustrative string doubling system.
Figure 14:
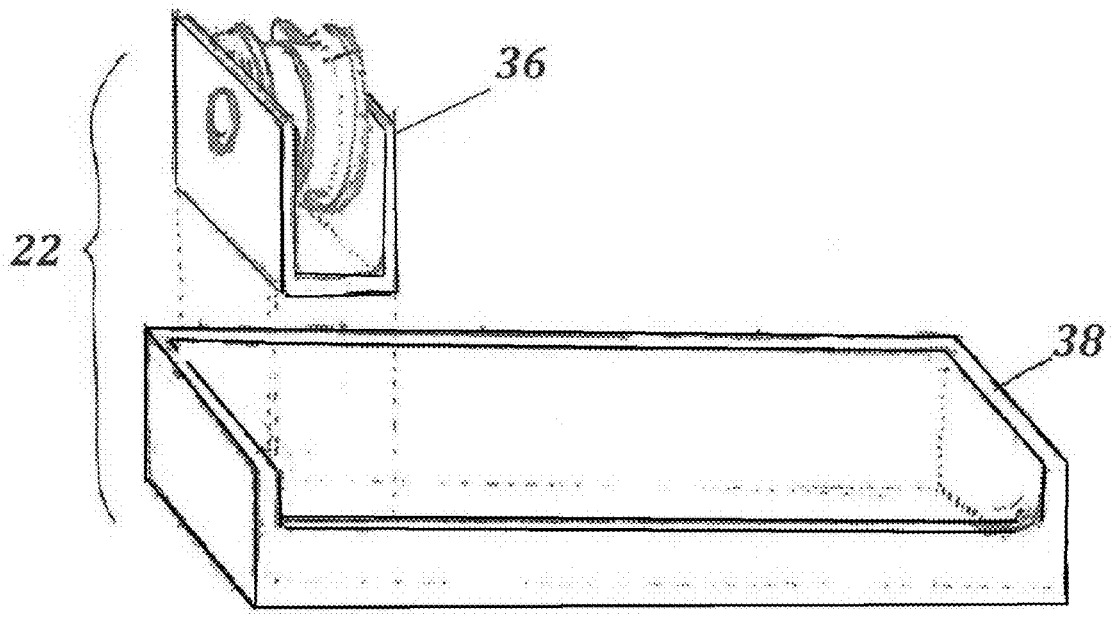
FIG. 14 shows a perspective view of another example of a nut portion of an illustrative string doubling system.
Figure 28:
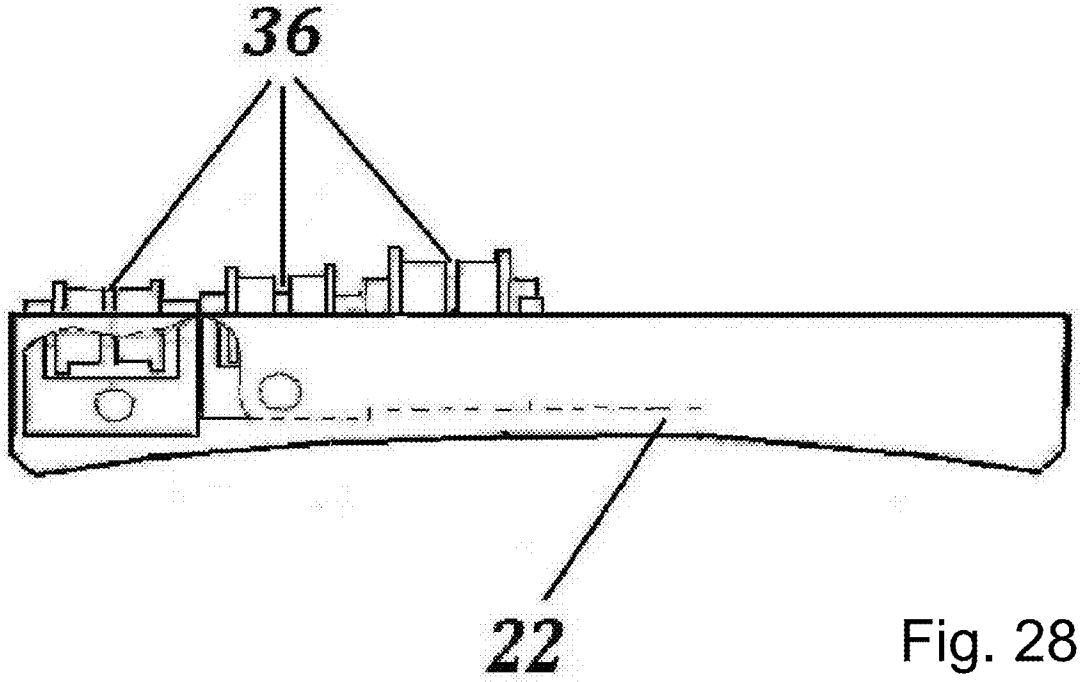
FIG. 28 shows another example of a nut portion having a curved lower surface.

FIG. 13 shows an illustrative nut apparatus 16. Nut apparatus 16 may be any suitable structure configured to secure and align a plurality of strings 20 in any combination of single and doubled arrangement, while allowing strings 20 to be tuned using an instrument's tuning pegs. For example, nut apparatus 16 may include nut 22 and/or string angle retainers 24. Nut apparatus 16 may be secured to guitar 10 using any suitable means, for example nut apparatus 16 may be bolted to guitar 10. Nut 22 may include nut saddle bearings 36 and/or nut base plate 38. Nut saddle bearings have similar function and construction as previously described bridge saddle bearings 28. Nut base plate 38 may include string holes 40 and/or string notches 42. Each of string holes 40 is any suitably sized through-way for mounting a string 20 such that a ball end 74 of string 20 will not pass through, facilitating doubling of string 20 as described above. String notches 42 may be provided to allow strings 20 to pass from nut apparatus 16 to their respective tuning pegs unimpeded. In some examples, nut base plate 38 may have a curved lower surface, as shown in FIG. 28. This may allow nut 22 to substantially conform to the contour of a corresponding instrument mounting surface.

String angle retainers (SAR) 24 (shown in FIGS. 17 and 26) may be any suitable structures configured to ensure a string is held at a desired angle, such as an angle configured to facilitate ease of tuning, as it traverses from nut to tuning peg. SAR 24 may be fixedly mounted in suitable locations on a head portion of a guitar 10. SAR 24 may include SAR base plate 44, SAR retainer bearing 46, and/or string hole 48. SAR base plate may be any suitable rigid structure configured to mount to guitar 10 and securely hold SAR retainer bearing 46 and withstand the strain caused by a tuned string 20. String hole 48 may be any suitable hole configured similar to string holes 40, and may functionally replace string holes 40 in some examples. In those examples, an illustrative nut apparatus 16 shown in FIG. 14 may be used. SAR retainer bearing 46 may be any vertical bearing structure configured to accept a corresponding string 20 and alter the angle of a corresponding string 20 as it travels from nut apparatus 16 to a tuning peg. This may facilitate tuning of a doubled string 20 by substantially matching string angles of a departing and returning portion of string 20.

Figure 15:
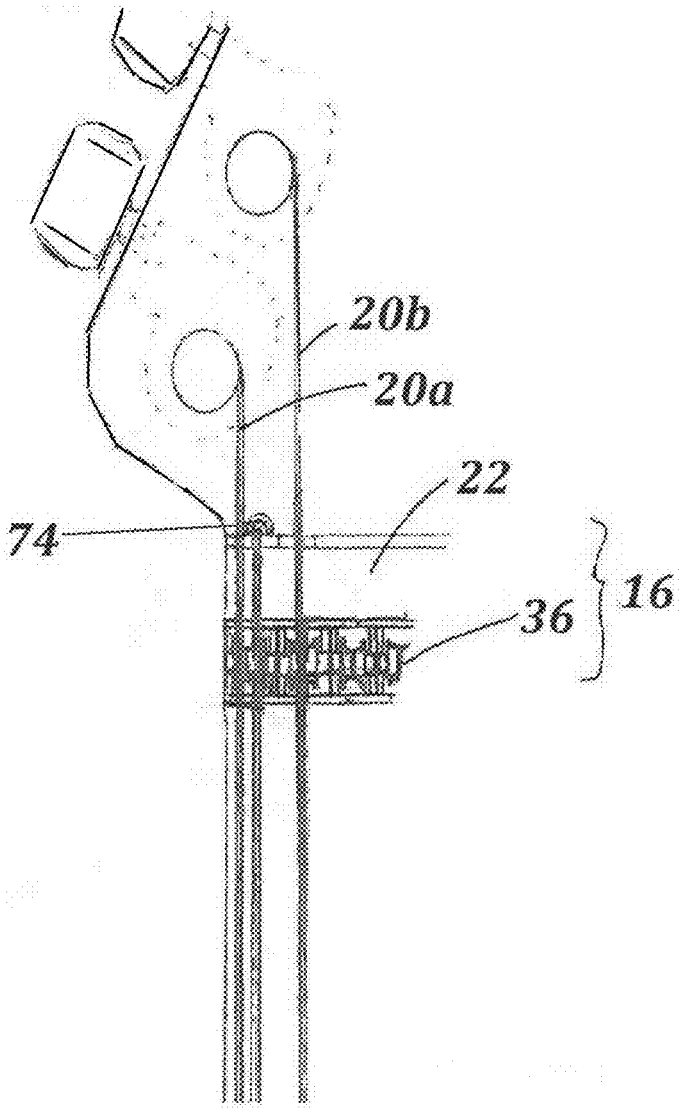
FIG. 15 shows a portion of an illustrative stringed instrument showing a location of an illustrative nut portion and two illustrative string configurations.
Figure 16:
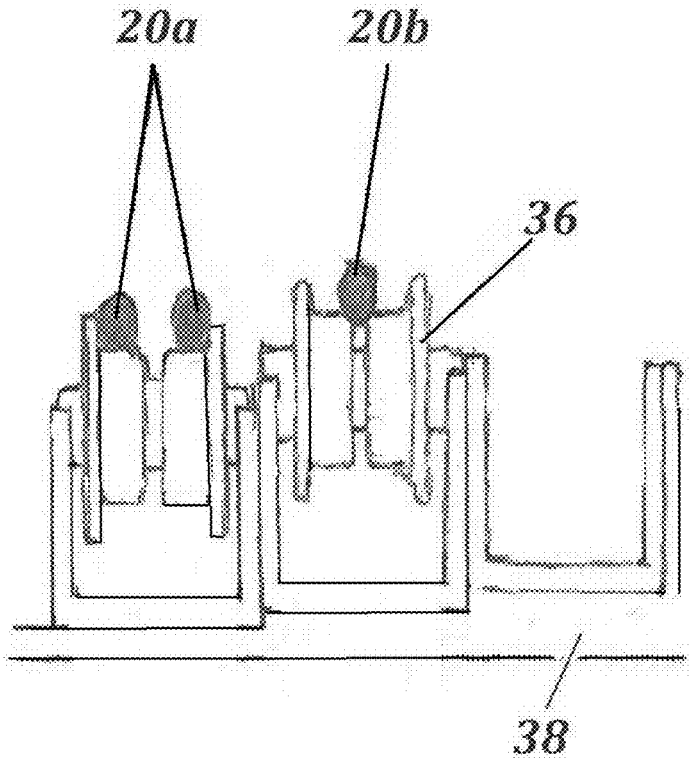
FIG. 16 is an end view of a portion of an illustrative nut assembly showing cross-sectional views of two illustrative string configurations.
Figure 17:
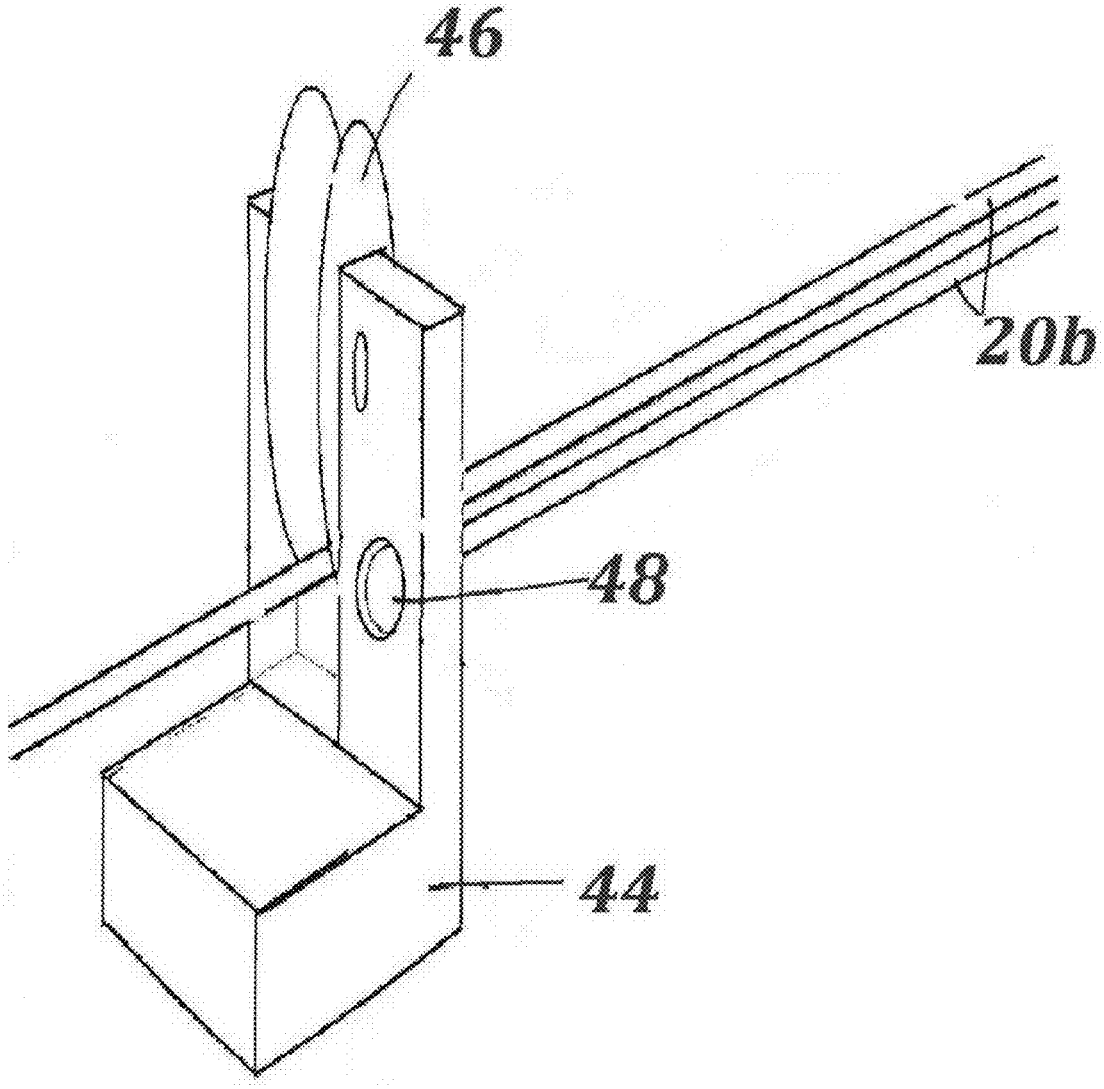
FIG. 17 shows a perspective view of an illustrative string retainer portion of an illustrative string doubling system.
Figure 18:
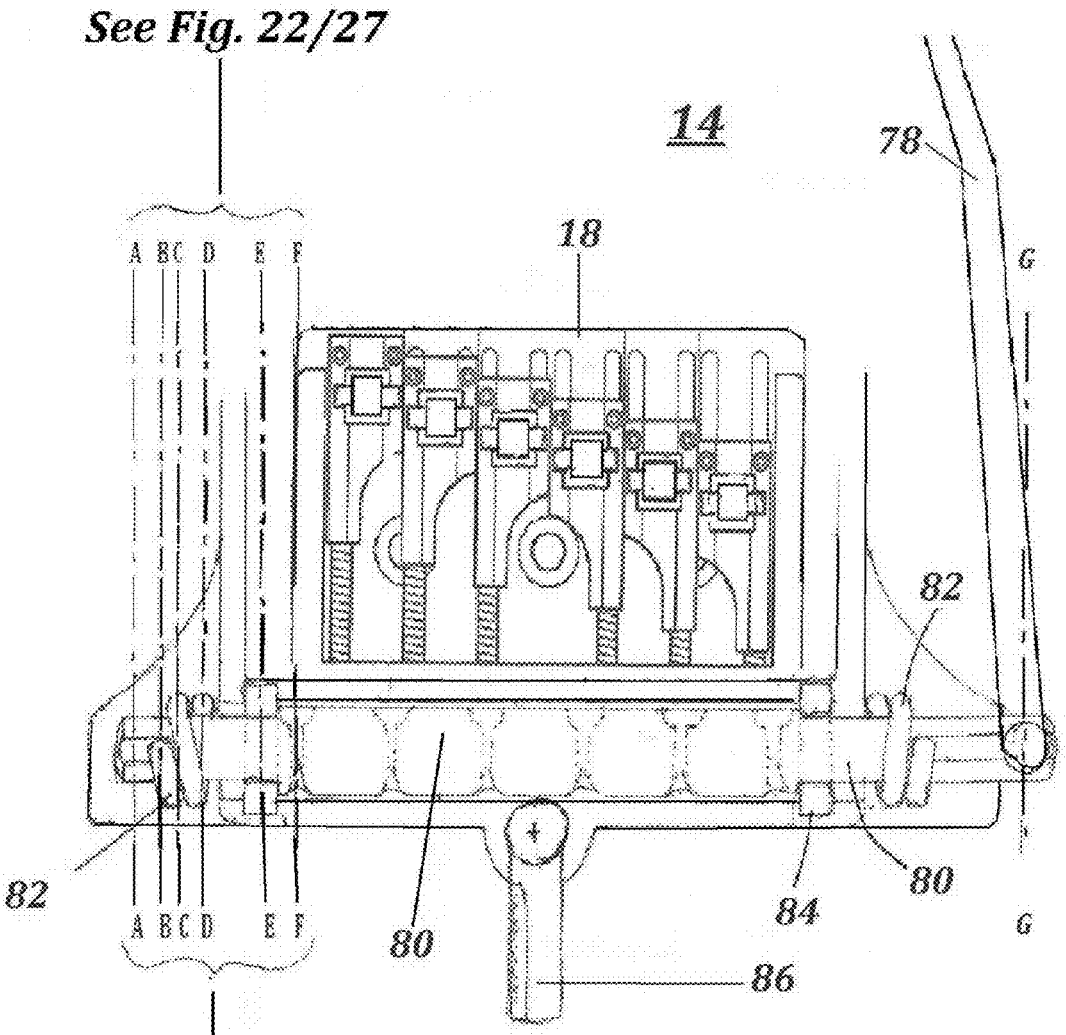
FIG. 18 shows a plan view of an illustrative whammy bar apparatus.
Figure 19:
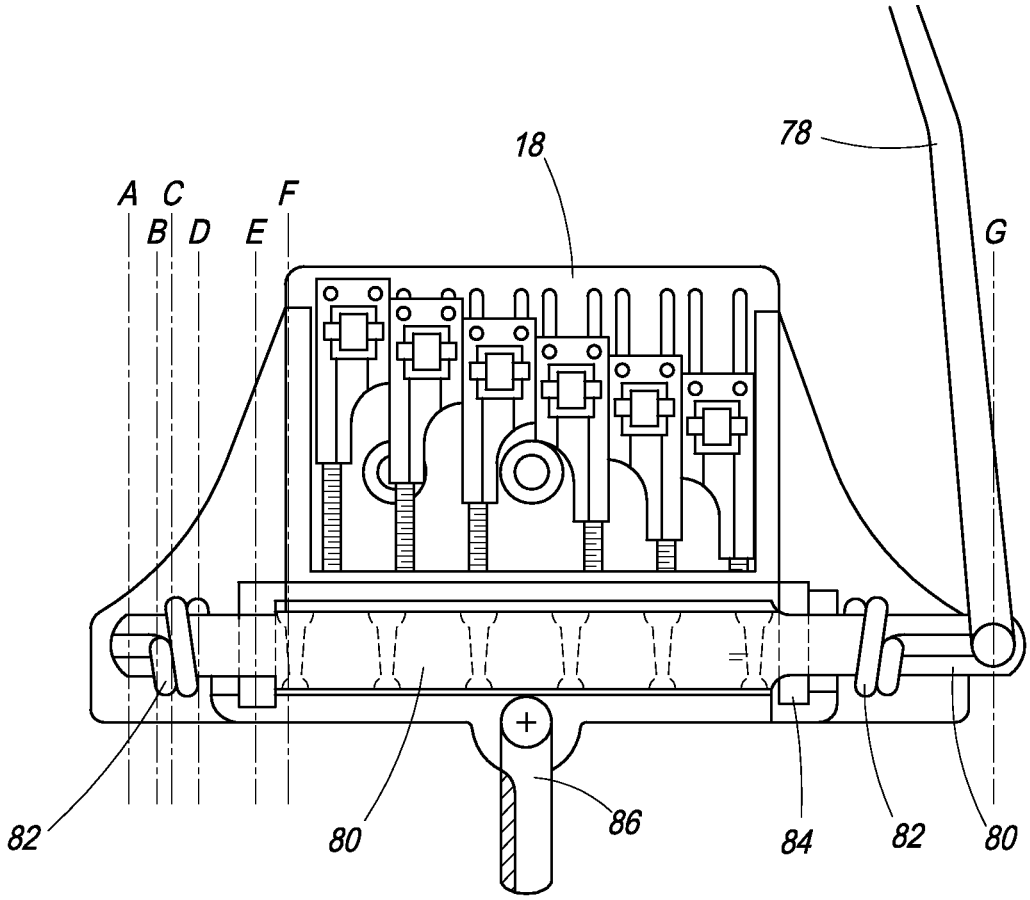
FIG. 19 shows a plan view and a schematic side elevation view of an illustrative whammy bar apparatus.
Figure 20:
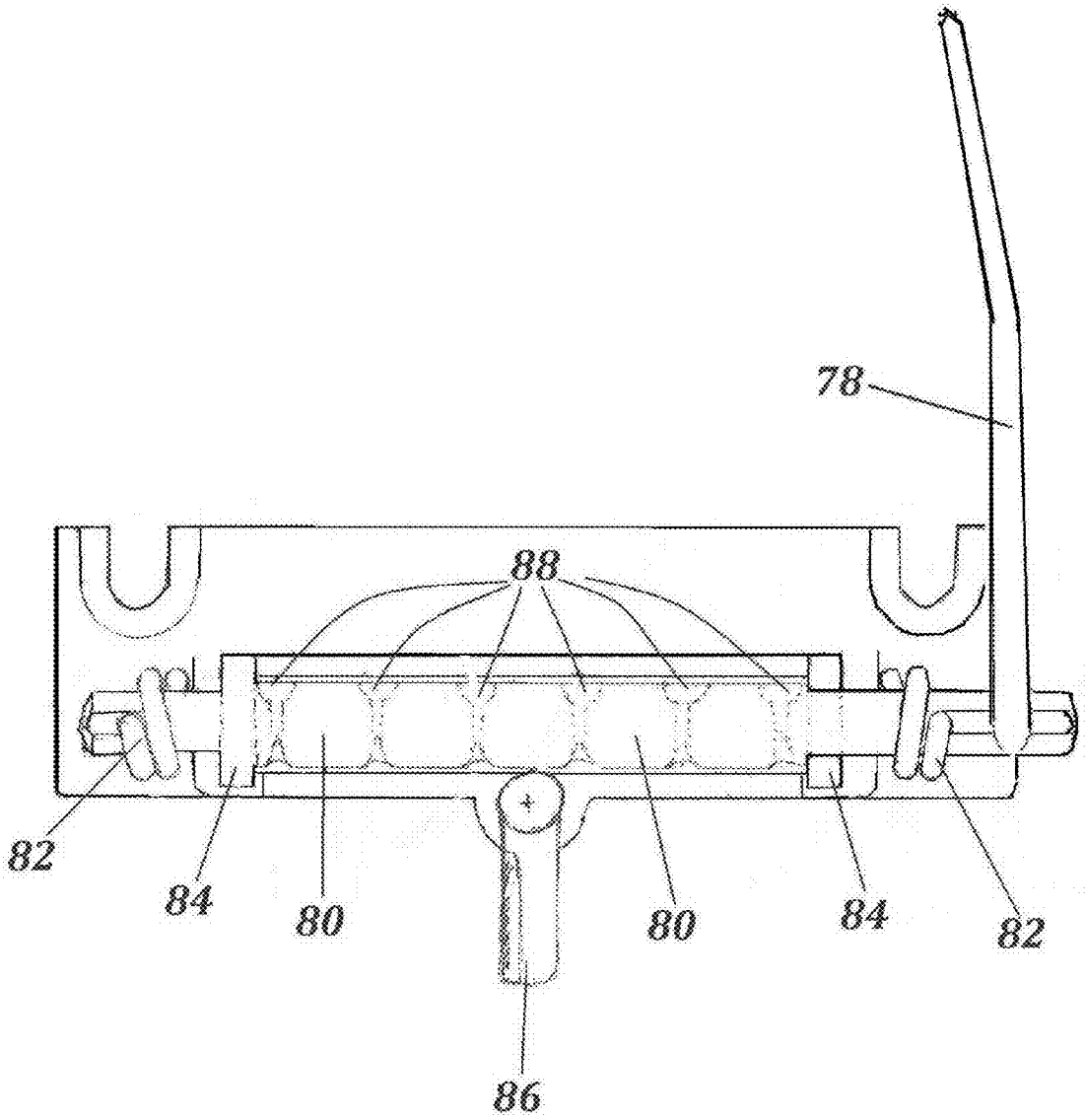
FIG. 20 shows a plan view of a portion of an illustrative whammy bar apparatus.
Figure 21:
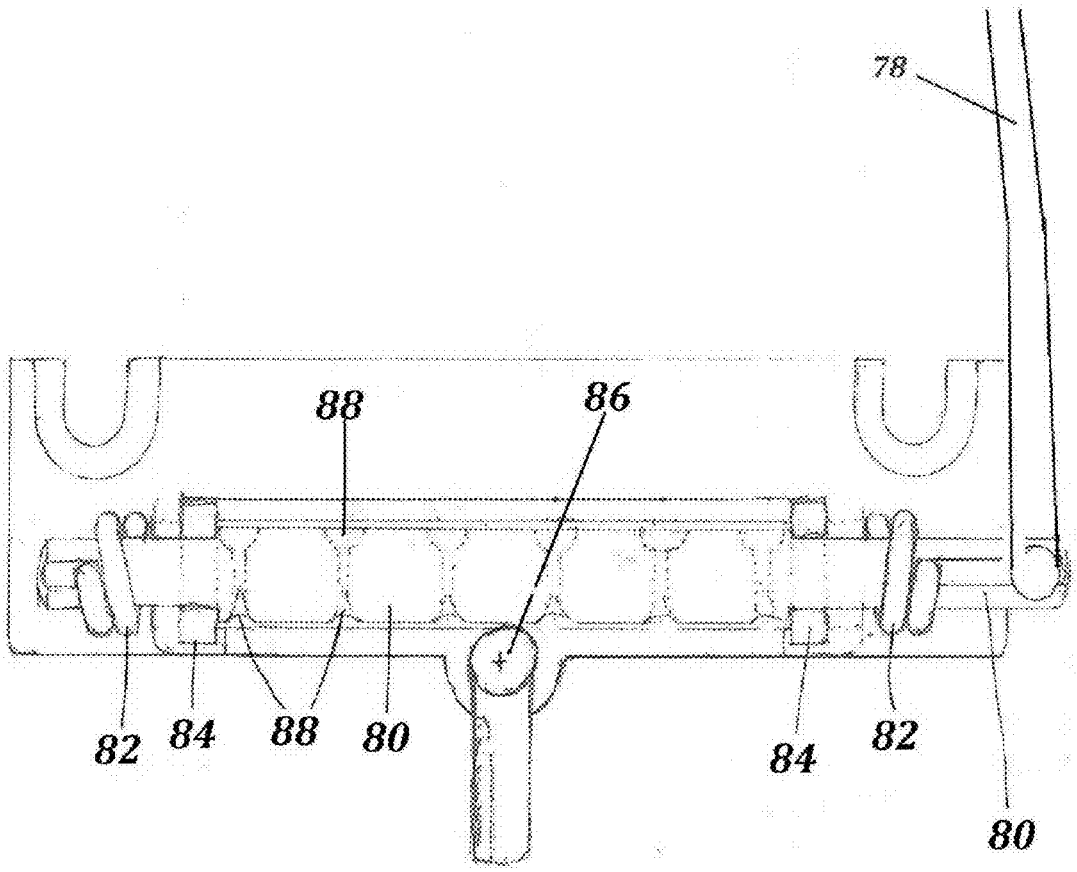
FIG. 21 shows a plan view of an illustrative whammy bar apparatus.
Figure 22:
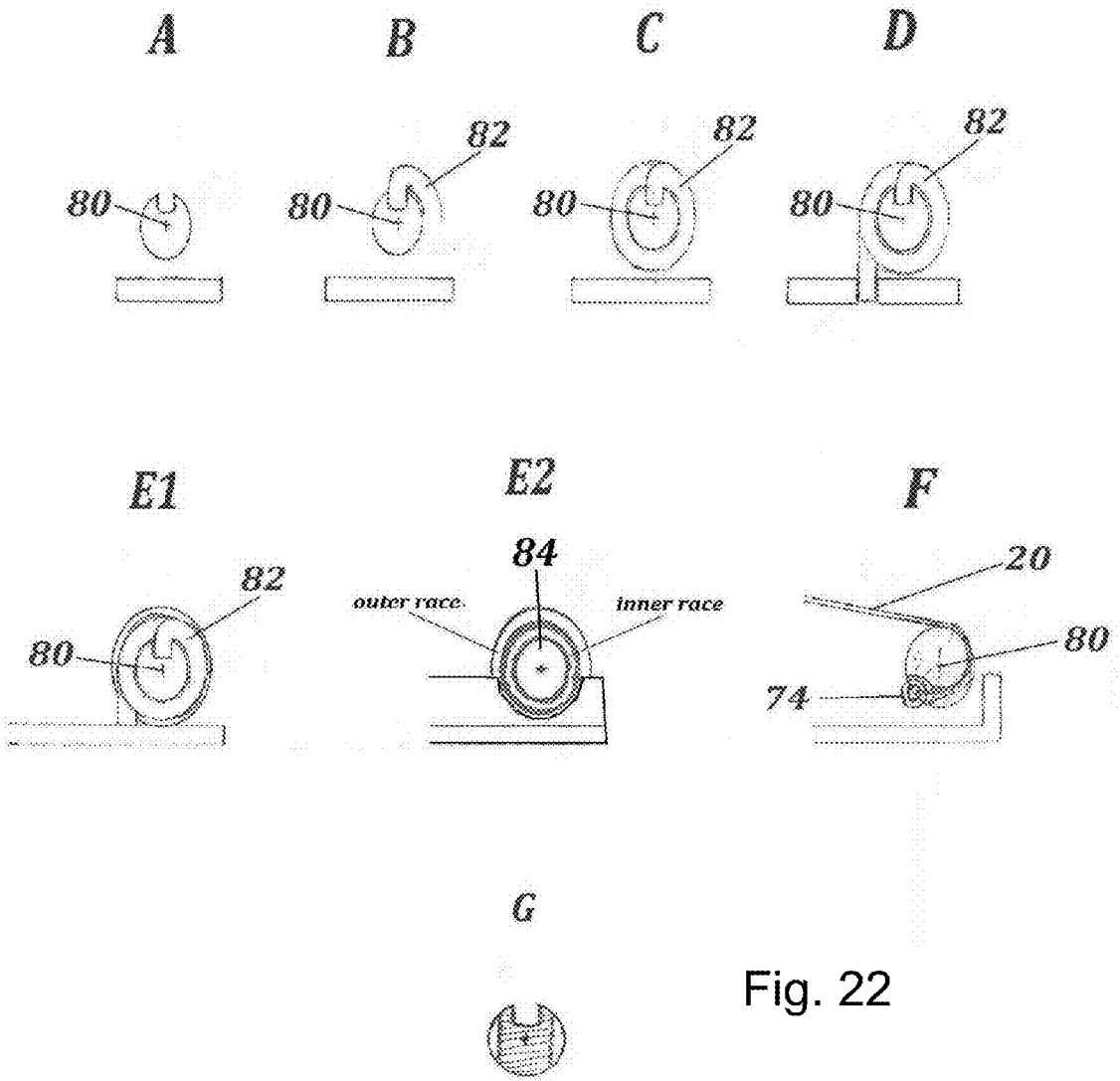
FIG. 22 shows various side views of a rotating rod and other components in an illustrative whammy bar apparatus.
Figure 23:
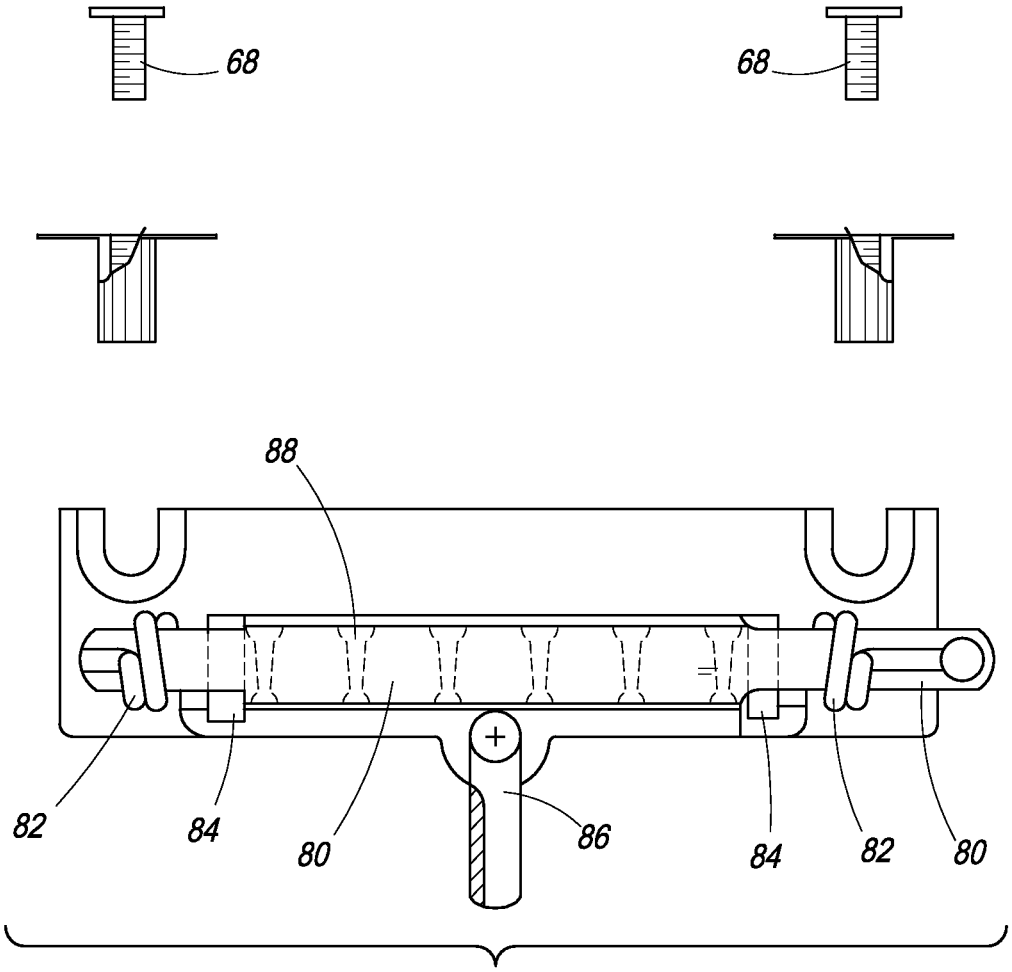
FIG. 23 shows a portion of an illustrative whammy bar apparatus and corresponding illustrative attachment bolt configurations.
Figure 24:
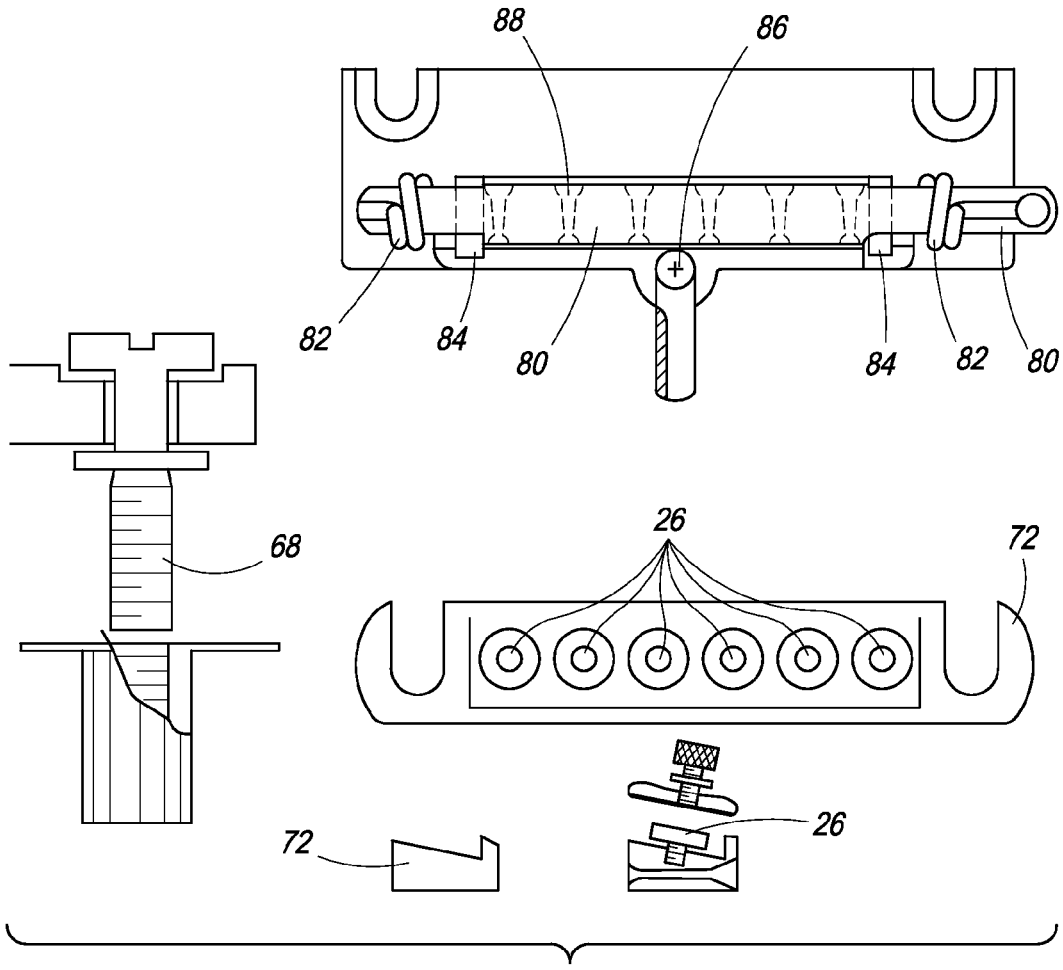
FIG. 24 shows a portion of an illustrative whammy bar apparatus (top) and a portion of an illustrative string doubling system (bottom), along with various other related components.
Figure 25:
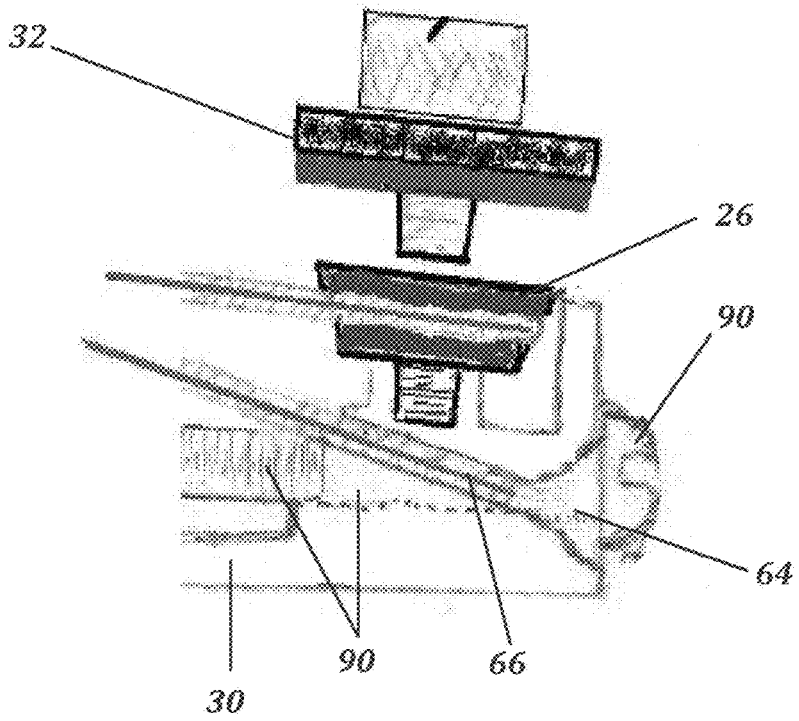
FIG. 25 shows a portion of an illustrative bridge apparatus.
Figure 26:
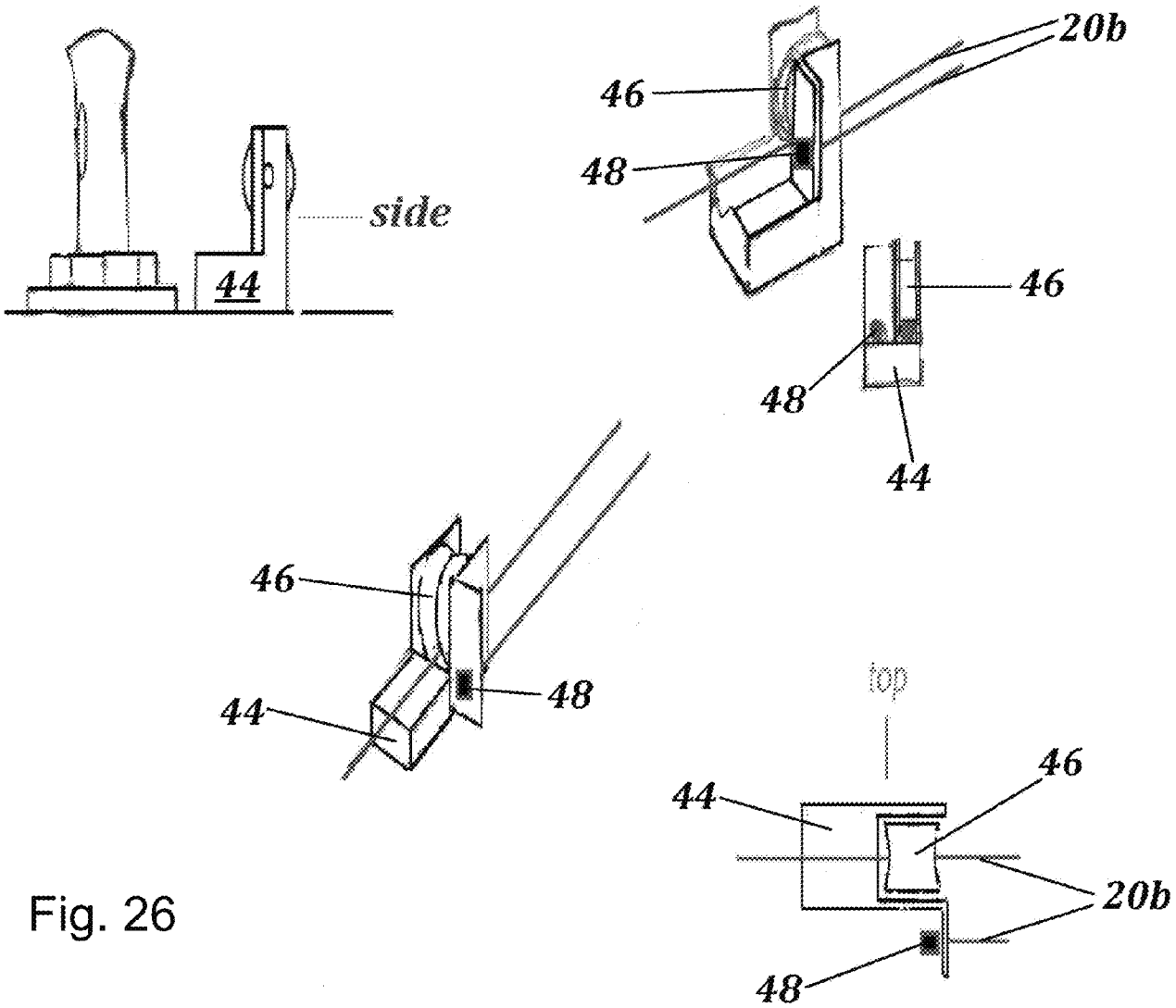
FIG. 26 shows further views of portions of an illustrative nut apparatus.
Figure 27:
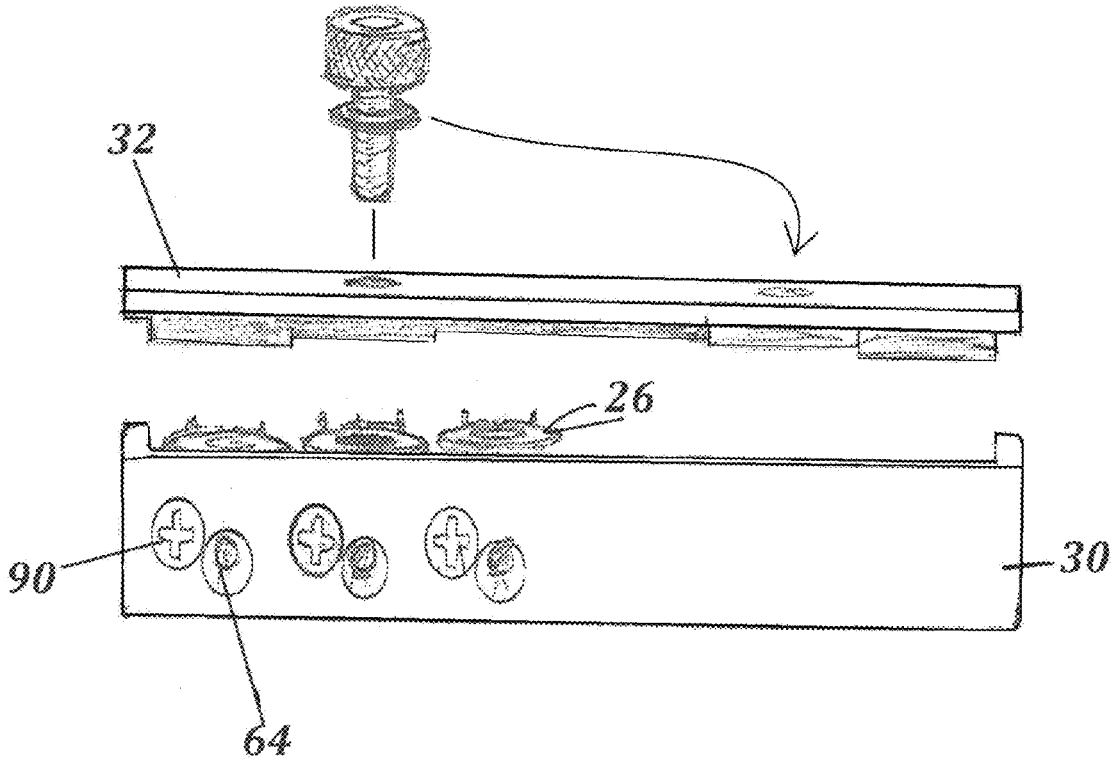
FIG. 27 shows further view and details of an illustrative bridge bearing lock.

FIG. 15 shows an example of a nut apparatus 16 mounted on an example instrument and showing a doubled string configuration, indicated at 20*a*, and a single string configuration, indicated at 20*b*. FIG. 16 shows a cross-sectional view of the example configuration shown in FIG. 15 and provides detail of how string configurations 20*a* and 20*b* may be aligned on nut saddle bearings 36.

FIGS. 18-24 show various examples and components of a face-mounted whammy bar system 14. Whammy bar system 14 may include tremolo or whammy arm 78, rotating rod 80, torsion spring 82, roller bearings 84, and/or locking mechanism 86. Whammy arm 78 may be any suitable structure configured to act as a lever for manipulating rotating rod 80, and may be a standard whammy bar arm already known in the art.

Rotating rod 80 may be any suitable structure configured to allow mounting of strings 20 and to vary tension on strings 20 when rotated axially. For example, rotating rod 80 may be a substantially cylindrical rod and may include string holes 88 and/or mounting holes or grooves for one or more torsion spring 82 and roller bearings 84. String holes 88 may be any suitable holes in rotating rod 80 configured to accept strings 20 while not allowing ball end 74 of each string to pass through, thus securely mounting one end of each string 20. Strings 20 may be secured, for example, by passing through string holes 88 toward a base end of the instrument, then wrapping around a top side of rotating rod 80 and proceeding to the nut end of the instrument as shown at "F" in FIG. 22.

Torsion spring 82 may be any suitable structure configured to act as an elastic mechanism to hold rotating rod 80 in rotational position when not being acted on by whammy arm 78 and to return rotating rod 80 to its original rotational position after being moved out of position by manipulation of whammy arm 78. For example, torsion spring 82 may include helical torsion springs as shown in FIGS. 18-24. Roller bearings 84 may be any suitable structures configured to act as axial bearings and to securely hold rotating rod 80 on a face of guitar 10.

Locking mechanism 86 may be any suitable structure configured to selectably stop whammy bar system 14 from operating. For example, locking mechanism 86 may include a lever arm and eccentric cam configured with essentially two positions. In first position, the eccentric cam may not be touching rotating rod 80. In a second position, manipulating the lever arm may cause the eccentric cam to rotate into a locking position wherein the cam may be pressed against rotating rod 80 and may thereby mechanically prevent it from rotating. An eccentric cam may be coated in rubber or some other material having a high coefficient of friction to facilitate locking.

The following paragraphs may provide further information on illustrative string doubling systems.

Stringing Method: Starting at nut end or headstock end of guitar, run string through string ball end hole. Pull string through until ball is seated in slot. String rests on nut bearing then runs the length of the fingerboard and neck to "6/12" fixed bridge. String then rests on bridge saddle bearing just as it did on nut bearing. At the very back end of the 6/12 fixed bridge is a horizontal bearing. String goes around and back up, running parallel with neck all the way up. Continue through string return slot ending at tuning peg 1.

With the guitar strung as described above, basically doubling the low E string, and each consecutive string thereafter, with a total of six doubled strings equaling 12 strings, because of the nut at the top end of neck and the horizontal bearing at the back end of bridge, it only takes one tuning peg for each doubled string. As you tune guitar, each string rolls freely along nut bearings, saddle bearings, and horizontal bearings, tuning both strings at the same time.

Although there are several different versions of the 6/12 bridge, e.g. "stopbar-tune-o-matic," "Acoustic 6/12," and the "fixed bridge" versions, they all may function in the same general manner.

There is also the option of not doubling the strings and running each string thru the "single string slot" behind and under each "horizontal bearing." Adding to the possibilities are the different combinations of both versions. For instance: doubling the low E, A, and D, leaving the G, B, and high E single. This configuration gives the top 6 strings a very rich, and full tone while leaving the bottom 3 strings available for easy soling. Any combination the player can think of will work.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. An accessory for a stringed instrument, the stringed instrument having a body with a face, a head portion, a neck disposed between the body and the head portion, and a plurality of instrument strings attached to the head portion and extending along the neck, the accessory comprising:

a bridge assembly being mountable to the face and having upper and lower surfaces, the lower surface being configured to be adjacent to the face when the accessory is mounted to the instrument, the upper surface being spaced from and opposite the lower surface;

a plurality of first bearings operatively attached to the upper surface, wherein each first bearing of the plurality of first bearings is configured to secure a central portion of an instrument string of the plurality of instrument strings such that a first end portion of the instrument string is attached to the head portion and extends along the neck passing from the neck to the body, securely reversing direction at the bearing, and passing back from the body to the neck to a second end portion that is attached to the head portion spaced from the first end portion;

a saddle bearing assembly haying a plurality of saddle bearings with each saddle bearing of the plurality of saddle bearings being configured to support a portion of an instrument string of the plurality of instrument strings in a spaced relationship from the body and to retain the portion of the instrument string in a spaced relationship from at least one of another portion of the instrument string and other instrument strings of the plurality of instrument string, wherein the saddle bearing assembly further includes a bearing base, wherein each saddle bearing of the plurality of saddle bearings includes a generally spool-shaped bearing body operatively attached to the bearing base, the bearing body having first and second flanged ends, a first cylindrical bearing surface proximate the first flanged end, a second cylindrical bearing surface proximate the second flanged end, and a circumferential gap between the first and second cylindrical bearing surfaces.

2. The accessory of claim 1, wherein each of the first bearings of the plurality of first bearings includes a substantially cylindrical shaft portion having a first end proximate to the upper surface and a second end opposite the first end, and a flanged head portion operatively attached to the second end of the shaft portion.

3. The accessory of claim 1, wherein each saddle bearing of the plurality of saddle bearings includes an adjustment member configured to adjustably move the saddle bearing toward or away from the neck when the accessory is mounted to the face.

4. The accessory of claim 1, where each instrument string of the plurality of instrument strings includes a first end portion attached to the head portion and a second end portion, wherein the bridge assembly further includes a plurality of through-holes running generally parallel to the body when the bridge assembly is mounted to the face, each through-hole of the plurality of through-holes being sized to accept and retain the second end portion of an instrument string of the plurality of instrument strings when a corresponding first bearing does not secure a central portion of the instrument string.

5. The accessory of claim 1, the accessory further including at least one mounting fastener configured to attach the bridge assembly to the face of a guitar.

6. An accessory for a stringed instrument, the stringed instrument having a body with a face, a head portion, a neck disposed between the body and the head portion, and a plurality of instrument strings attached to the head portion and extending along the neck, the accessory comprising:

a bridge assembly being mountable to the face and having upper and lower surfaces, the lower surface being configured to be adjacent to the face when the accessory is mounted to the instrument, the upper surface being spaced from and opposite the lower surface;

a plurality of first bearings operatively attached to the upper surface, wherein each first bearing of the plurality of first bearings is configured to secure a central portion of an instrument string of the plurality of instrument strings such that a first end portion of the instrument string is attached to the head portion and extends along the neck passing from the neck to the body, securely reversing direction at the bearing, and passing back from the body to the neck to a second end portion that is attached to the head portion spaced from the first end portion; and a nut assembly mountable to the neck, the nut assembly including a nut base and a plurality of nut saddle bearings, each nut saddle bearing of the plurality of nut saddle bearings being configured to retain a portion of an instrument string of the plurality of instrument strings in a spaced relationship from the neck and to retain the portion of the instrument string in a spaced relationship from at least one of another portion of the instrument string and other instrument strings of the plurality of instrument strings, where the head portion includes a tuning component, the accessory further including a retainer assembly mountable to the head portion, the retainer assembly having an aperture and a retainer bearing having a bearing surface, the aperture being sized to allow a first portion of an instrument string of the plurality of instrument strings to pass through and be retained by the aperture, and the bearing surface being configured to guide a second portion of the instrument string toward the tuning component, wherein the retainer bearing and the aperture are substantially the same distance from one of the first bearings of the plurality of first bearings of the bridge assembly, the first bearing being further configured to act as a pivot between the first portion of the string and the second portion of the string.

7. The accessory of claim 6, wherein each of the first bearings of the plurality of first bearings includes a substantially cylindrical shaft portion having a first end proximate to the upper surface and a second end opposite the first end, and a flanged head portion operatively attached to the second end of the shaft portion.

8. The accessory of claim 6, wherein each saddle bearing of the plurality of saddle bearings includes an adjustment member configured to adjustably move the saddle bearing toward or away from the neck when the accessory is mounted to the face.

9. The accessory of claim 6, where each instrument string of the plurality of instrument strings includes a first end portion attached to the head portion and a second end portion, wherein the bridge assembly further includes a plurality of through-holes running generally parallel to the body when the bridge assembly is mounted to the face, each through-hole of the plurality of through-holes being sized to accept and retain the second end portion of an instrument string of the plurality of instrument strings when a corresponding first bearing does not secure a central portion of the instrument string.

10. The accessory of claim 6, the accessory further including at least one mounting fastener configured to attach the bridge assembly to the face of a guitar.

11. A tremolo apparatus for a stringed instrument having a body with a face, a head portion, a neck disposed between the body to the head portion, and a plurality of instrument strings extending along the neck from a first terminal end adjacent the head portion to a second terminal end adjacent the body, the tremolo apparatus comprising:

a rod rotatable about a longitudinal axis and having a plurality of apertures, each aperture sized to accept an instrument string of the plurality of instrument strings;

at least one axial bearing configured to hold the rod in a transverse orientation relative to the plurality of instrument strings and in a spaced relationship from the face, the axial bearing being operatively connectable to a portion of the face proximate to the second terminal end of the instrument strings; and a torsion spring operatively connected to the rod, the torsion spring being configured to bias the rod toward a first rotational position, wherein movement of the rod from the first rotational position to a second rotational position different from the first rotational position varies tension on one or more instrument strings of the plurality of instrument strings passing through corresponding apertures of the rod.

12. The apparatus of claim 11, further including a whammy bar operatively connected to the rod and configured such that manual repositioning of the whammy bar from a first position to a second position causes the rod to rotate between the first rotational position and the second rotational position.

13. The apparatus of claim 12, further including a locking device disposed adjacent to the rotatable rod, the locking device having a pivotable lever arm connected to an eccentric cam, wherein placing the lever arm in a first position causes the eccentric cam to engage the rotatable rod, and placing the lever arm in a second position causes the eccentric cam to be disengaged from the rotatable rod.

14. The apparatus of claim 11, the tremolo apparatus being configured to be selectively mountable to the face of a guitar via one or more fasteners.

15. The apparatus of claim 11, further including a generally planar base plate disposed between the axial bearing and the face.

16. The apparatus of claim 15, further including a plurality of saddle bearings mounted on the base plate between the rotatable rod and the neck of the instrument.

17. A method for doubling an instrument string on a stringed instrument having a head portion, a body, and a neck disposed between the head portion and the body, the method comprising:

threading an instrument string having a ball end through an aperture of a retainer device at the neck until the ball end seats at a seating surface of the aperture;

passing the instrument string over a first portion of a nut, down the neck, and over a first bearing surface of a saddle bearing mounted on the face of the instrument body;

passing the instrument string to a bridge bearing of a bridge mounted on the face of the body;

pivoting the instrument string around a bearing surface of the bridge bearing;

passing the instrument string over a second bearing surface of the saddle bearing and up the neck;

passing the instrument string over a second portion of the nut;

passing the instrument string over a bearing surface of the retainer device; and securing the instrument string at a tuning peg of the head.

18. The method of claim 17, wherein the retainer device is an integrated part of the nut.

19. The method of claim 17, wherein passing the instrument string over a first portion of the nut includes passing the instrument string through an aperture of the nut.

20. The method of claim 17, wherein the instrument string is at least twice the length of a standard instrument string.

* * * * *